US007524005B2

(12) United States Patent
Inoue

(10) Patent No.: US 7,524,005 B2
(45) **Date of Patent: *Apr. 28, 2009**

(54) LIQUID EJECTION APPARATUS, INKJET RECORDING APPARATUS AND LIQUID REMOVAL METHOD

(75) Inventor: Hiroshi Inoue, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 442 days.

This patent is subject to a terminal disclaimer.

(21) Appl. No.: 11/385,780

(22) Filed: Mar. 22, 2006

(65) Prior Publication Data

US 2006/0214958 A1 Sep. 28, 2006

(30) Foreign Application Priority Data

Mar. 23, 2005 (JP) ..... 2005-084555

(51) Int. Cl.
*B41J 29/38* (2006.01)
*B41J 2/01* (2006.01)

(52) U.S. Cl. ..... 347/5; 347/101

(58) Field of Classification Search ..... 347/22, 347/23, 28, 5, 101
See application file for complete search history.

(56) References Cited

U.S. PATENT DOCUMENTS 5,355,158 A * 10/1994 Inada et al. ..... 347/22
5,365,261 A 11/1994 Ozawa et al.
7,364,266 B2 * 4/2008 Konno ..... 347/43
7,370,948 B2 * 5/2008 Inoue ..... 347/84

FOREIGN PATENT DOCUMENTS

JP 6-126945 A 5/1994
JP 2001-179959 A 7/2001
JP 2002290729 A * 10/2002

* cited by examiner

*Primary Examiner*—An H Do
(74) *Attorney, Agent, or Firm*—Birch, Stewart, Kolasch & Birch, LLP

(57) ABSTRACT

A liquid ejection apparatus which includes: a liquid ejection head which ejects liquid onto a liquid receiving medium; a conveyance device which conveys the liquid receiving medium in a conveyance direction relatively to the liquid ejection head, by moving at least one of the liquid receiving medium and the liquid ejection head; a liquid removal device which is arranged on a downstream side of the liquid ejection head in the conveyance direction and removes the liquid on the liquid receiving medium; a movement device which varies a distance between the liquid removal device and the liquid receiving medium, by moving the liquid removal device; an ejection volume determination device which determines a liquid ejection volume being a volume of the liquid ejected on the liquid receiving medium; and a liquid removal control device which determines whether or not to carry out liquid removal from the liquid receiving medium.

12 Claims, 16 Drawing Sheets

FIG.8

| TYPE OF MEDIUM | THRESHOLD VALUE (ml/m$^2$) |
|---|---|
| PPC PAPER | 8 |
| ART PAPER/COATED PAPER | 5 |
| SPECIAL INKJET PHOTOGRAPHIC PAPER | 25 |
| NON-PERMEABLE MEDIUM | ZERO (SOLVENT REMOVAL NOT PERFORMED IF LIQUID NOT EJECTED) |

FIG.9

| TYPE OF MEDIUM | THRESHOLD VALUE (ml/m$^2$) |
|---|---|
| PPC PAPER | 7 |
| ART PAPER/COATED PAPER | 4.5 |
| SPECIAL INKJET PHOTOGRAPHIC PAPER | 22 |
| NON-PERMEABLE MEDIUM | ZERO (SOLVENT REMOVAL NOT PERFORMED IF LIQUID NOT EJECTED) |

FIG.10

| | | HUMIDITY (%) | | |
|---|---|---|---|---|
| | | LESS THAN 20 | 20 OR ABOVE AND LESS THAN 50 | 50 OR ABOVE |
| TEMPERATURE (°C) | LESS THAN 10 | ×1 | ×0.9 | ×0.8 |
| | 10 OR ABOVE AND LESS THAN 30 | ×1.1 | ×1 | ×0.9 |
| | 30 OR ABOVE | ×1.2 | ×1.1 | ×1 |

LIQUID EJECTION APPARATUS, INKJET RECORDING APPARATUS AND LIQUID REMOVAL METHOD

BACKGROUND OF THE INVENTION

1. Field of the Invention

The present invention relates to a liquid ejection apparatus, an inkjet recording apparatus and a liquid removal method, and more particularly, to liquid removal technology which efficiently removes surplus liquid on a liquid receiving medium.

2. Description of the Related Art

In recent years, inkjet recording apparatuses have come to be used widely as data output apparatuses for outputting images, documents, or the like. An inkjet recording apparatus forms an image, document, or the like, corresponding to data, on a recording medium by ejecting ink from nozzles, by driving actuators corresponding to nozzles provided in a print head, in accordance with data.

In an inkjet recording apparatus, since a liquid ink is used in which coloring material and additives are included in a solvent, such as water or alcohol, then the ink (ink solvent) remains on the medium after image formation. When the ink solvent remaining on the medium makes contact with another medium, it may give rise to soiling of the recorded image. Furthermore, the ink solvent remaining on the medium may be a cause of cockling of the medium. In an inkjet recording apparatus, a heater, an absorbing member for absorbing the liquid, and the like, are provided on the downstream side of the head, in such a manner that the ink solvent remaining on the medium after image formation is removed swiftly.

On the other hand, another inkjet recording apparatus uses a method which promotes the fixing of the ink onto the medium by making the treatment liquid react with the ink on the medium. In this method also, if there is treatment liquid present on a region where the ink is not present, then this treatment liquid may remain on the medium after image formation, and hence it is necessary to swiftly remove the treatment liquid remaining on the medium, as well.

In the ink absorbing body and the image forming apparatus and method using an ink absorbing body described in Japanese Patent Application Publication No. 2001-179959, an ink absorbing body is provided, which comprises a liquid solvent absorbing body and a separating member that covers the surface of the liquid solvent absorbing body at least partially and allows the ink solvent to pass, while having separating properties with respect to the coloring material of the ink. When ink is deposited on a sheet, the liquid solvent absorbing body is placed in proximity to a portion of the sheet, through the separating member, and liquid solvent is absorbed into the liquid solvent absorbing body, through the separating member, in such a manner that the coloring material and the liquid solvent of the liquid ink on the sheet are separated from each other.

Furthermore, in the transfer type inkjet printer described in Japanese Patent Application Publication No. 6-126945, ions of the same polarity as colored charged particles in the ink are irradiated onto an ink image formed on a transfer drum, by means of a corotron charger, thereby separating the colored particles from the oil-based solvent, whereupon the oil-based solvent is removed by means of a solvent removal device which uses a polytetrafluoroethylene mesh.

When the solvent remaining on the medium is removed by applying heat to the medium by means of a heater, it is difficult to remove solvent from a specific region of the medium, and it is also difficult to control the amount of heat applied to the medium from the heater, in accordance with the volume of the remaining solvent. On the other hand, if the solvent remaining on the medium is absorbed by using an absorbing body, then it is necessary to provide maintenance members, such as a member which removes the coloring material (solute) of the ink adhering to the surface of the absorbing body, and a member which removes the solvent remaining on the absorbing body.

In the ink absorbing body and the image forming apparatus and the method using the ink absorbing body as described in Japanese Patent Application Publication No. 2001-179959, and the transfer type inkjet printer as described in Japanese Patent Application Publication No. 6-126945, a composition is adopted in which the medium makes contact with the ink absorbing body even when removal of the ink solvent is not required, and hence there is a probability that soiling on the ink absorbing body adheres to the medium, thereby degrading the image formed on the medium. Furthermore, there is also a probability that the ink absorbing body may deform if the ink absorbing body makes contact with the medium for a prolonged period of time, and hence there are concerns regarding decline in the ink solvent removal capability.

SUMMARY OF THE INVENTION

The present invention has been contrived in view of the foregoing circumstances, an object thereof being to provide a liquid ejection apparatus, an inkjet recording apparatus and a liquid removal method, in which the removal of solvent remaining on the medium is carried out in accordance with the conditions.

In order to attain the aforementioned object, the present invention is directed to a liquid ejection apparatus, comprising: a liquid ejection head which ejects liquid onto a liquid receiving medium; a conveyance device which conveys the liquid receiving medium in a conveyance direction relatively to the liquid ejection head, by moving at least one of the liquid receiving medium and the liquid ejection head; a liquid removal device which is arranged on a downstream side of the liquid ejection head in the conveyance direction and removes the liquid on the liquid receiving medium; a movement device which varies a distance between the liquid removal device and the liquid receiving medium, by moving the liquid removal device; an ejection volume determination device which determines a liquid ejection volume being a volume of the liquid ejected on the liquid receiving medium; and a liquid removal control device which determines whether or not to carry out liquid removal from the liquid receiving medium in accordance with the liquid ejection volume determined by the ejection volume determination device, and implements control for moving the liquid removal device in such a manner that the liquid removal device is placed in contact with the liquid on the liquid receiving medium if the liquid on the liquid receiving medium is to be removed, and the liquid removal device is not placed in contact with the liquid on the liquid receiving medium if the liquid on the liquid receiving medium is not to be removed.

According to the present invention, when removing the liquid that has been ejected onto the liquid receiving medium, the liquid removal device is placed in contact with the liquid, and when not removing the liquid that has been ejected onto the liquid receiving medium, the liquid removal device is moved so that it does not make contact with the liquid. Therefore, soiling of the liquid receiving medium due to the liquid removal device making contact with the liquid receiving medium is prevented, and furthermore, wearing and deformation of the liquid removal device is suppressed, and increased lifespan of the liquid removal device can be achieved. Furthermore, since it is determined whether or not to perform liquid removal on the basis of the ejection volume of the liquid ejected onto the liquid receiving medium, then it is possible to remove the liquid efficiently in accordance with the liquid volume on the liquid receiving medium.

Moreover, in a mode where a drying device for drying the liquid receiving medium after liquid ejection is provided, it is possible to increase the drying efficiency of the liquid receiving medium, thereby contributing to reducing the load of the drying device.

The ejection volume of the liquid may be calculated from the ejection data. Furthermore, it is also possible to determine the solvent volume (the volume of the liquid minus the amount of solute), from the ejection volume, instead of the liquid ejection volume, in such a manner that the determination of whether or not to carry out solvent removal is made on the basis of this solvent volume.

The liquid removal device includes an absorbing member (liquid absorbing body) which absorbs the liquid (in other words, removes the liquid by contact) from the recording medium, by making contact with the liquid. A porous member or polymer, or the like, may be used suitably as the absorbing member.

When removing the solvent, the liquid removal device is placed in contact with the liquid on the surface of the liquid receiving medium. By placing the liquid removal device in contact with the liquid receiving medium, increased efficiency in liquid removal can be expected. Moreover, if the liquid solvent device makes contact with the liquid receiving medium at a prescribed pressure, then further improvement in liquid removal efficiency can be expected.

The liquid ejection head may be a line type head having an ejection hole row comprising a plurality of ejection holes for ejecting liquid, having a length corresponding to the full width of the liquid receiving medium (the width of the region which can receive liquid), or it may be a serial type head which is a short head having a length that does not reach the full width of the liquid receiving medium and which is scanned in the breadthways direction of the liquid receiving medium.

A line ejection head may be formed to a length corresponding to the full width of the recording medium by combining short head having rows of ejection holes which do not reach a length corresponding to the full width of the liquid receiving medium, these short heads being joined together in a staggered matrix fashion.

Moreover, the "liquid receiving medium" represents a medium which receives liquid ejected from the liquid ejection head, and this term includes various types of media, irrespective of material and size, such as continuous paper, cut paper, sealed paper, resin sheets, such as OHP sheets, film, cloth, and other materials.

Preferably, the liquid ejection apparatus further comprises: a liquid receiving medium determination device which determines a type of the liquid receiving medium; and a threshold value specification device which specifies a threshold value corresponding to the liquid receiving medium, wherein the liquid removal control device compares the threshold value corresponding to the type of liquid receiving medium determined by the liquid receiving medium determination device with the liquid ejection volume determined by the ejection volume determination device, and implements control in such a manner that the liquid on the liquid receiving medium is removed in cases where the liquid ejection volume is greater than the threshold value.

Since the type of liquid receiving medium is determined, and it is determined whether or not to perform liquid removal on the basis of a threshold value which is set with respect to the type of liquid receiving medium thus determined, then desirable liquid removal can be carried out in accordance with the type of liquid receiving medium. Furthermore, if the liquid volume which can be received by the liquid receiving medium is taken into account, then it is possible to prevent cockling of the liquid receiving medium.

The mode of determining the type of liquid receiving medium by the liquid receiving medium determination device may involve the operator (user) inputting the type of liquid receiving medium (liquid receiving medium information) directly, or alternatively, the liquid receiving medium may be read in directly by means of a determination device, such as a sensor or imaging element, the type of liquid receiving medium being determined automatically on the basis of the results thus read in. Furthermore, it is also possible to adopt a composition in which an information recording body (memory, IC tag, or the like) which stores information including information on the liquid receiving medium is provided in the supply device which supplies to the liquid receiving medium, in such a manner that the type of liquid receiving medium (media type) is read in from this information recording body.

The threshold values specified by the threshold value specification device are recorded previously in the form of a data table corresponding to respective types of recording medium, and stored in a storage device.

Preferably, the liquid ejection apparatus further comprises: a temperature information acquisition device which acquires ambient temperature information for the liquid receiving medium; a humidity information acquisition device which acquires ambient humidity information for the liquid receiving medium; and a threshold value correction device which corrects the threshold value in accordance with at least one of the temperature information acquired by the temperature information acquisition device and the humidity information acquired by the humidity information acquisition device.

Since the threshold value used to determine whether or not to carry out liquid removal is corrected in accordance with the temperature information and the humidity information, then it is possible to respond to changes in the environmental conditions.

Preferably, the ejection volume determination device calculates the liquid ejection volume to be ejected onto the liquid receiving medium according to ejection data of the liquid ejected onto the liquid receiving medium.

Since the ejection volume of the liquid ejected onto the liquid receiving medium is calculated on the basis of the liquid ejection data, it is possible readily to determine the liquid volume on the liquid receiving medium, and therefore desirable liquid removal can be achieved, in accordance with the liquid volume on the liquid receiving medium.

The ejection data corresponds to the image data in an inkjet recording apparatus which forms images by means of ink, for example, and therefore, liquid can be removed in accordance with the contents of the image.

Preferably, the liquid ejection apparatus further comprises: an extraction device which extracts regions of high liquid ejection volume from a possible liquid ejection range on the liquid receiving medium, according to the liquid ejection volume calculated by the ejection volume determination device, wherein the liquid removal control device implements control in such a manner that liquid removal is performed in the regions extracted by the extraction device.

Since the regions of high liquid volume calculated by the liquid volume determination device are extracted and control is implemented in such a manner that the liquid is removed from the extracted regions, then it is possible to perform liquid removal with respect to regions having a high liquid volume, and therefore, increased lifespan of the liquid removal device can be expected.

It is also possible to determine the distribution of the liquid volume from the ejection data and to extract the regions of high liquid volume on the basis of this ejection volume distribution.

Preferably, the liquid ejection apparatus further comprises: a dividing device which divides a possible liquid ejection range on the liquid receiving medium, into a plurality of blocks, wherein: the ejection volume determination device determines the liquid ejection volume in each of the blocks of the liquid receiving medium divided by the dividing device; and the liquid removal control device implements control in such a manner that liquid removal is carried out in accordance with the liquid ejection volume determined for each block.

Since the region of the possible liquid ejection region of the liquid receiving medium is divided into a plurality of blocks, and solvent removal is carried out respectively for each block by determining the liquid ejection volume in each block, then further increased lifespan of the liquid removal device can be expected.

Preferably, the liquid removal device has a structure which is divided into a plurality of parts in a direction substantially perpendicular to the conveyance direction; and the liquid removal control device implements control in such a manner that liquid removal is performed by each of the divided parts of the liquid removal device.

Since the liquid removal device is divided in a direction substantially perpendicular to the conveyance direction of the liquid receiving medium, thereby achieving a composition in which liquid can be removed independently by the divided liquid removal devices, then it is possible to achieve desirable liquid removal in accordance with the distribution of the liquid volume on the liquid receiving medium.

Furthermore, the divided liquid removal devices can be maintained (replaced, etc.) individually, and hence improved maintenance characteristics can be expected. Furthermore, reduced costs can be anticipated through the adopted of a unit-based structure.

As a mode of dividing the liquid removal device in a direction substantially perpendicular to the conveyance direction, it is possible to dispose the divided liquid removal devices in a staggered fashion following the direction substantially perpendicular to the conveyance direction, or to dispose same in one row. If the divided liquid removal devices are disposed in a staggered fashion, then adjacent liquid removal devices should be displaced so as to have mutually overlapping regions in their direction of alignment.

Preferably, the liquid ejection apparatus further comprises a cleaning device which cleans the liquid removal device.

By cleaning the liquid removal device, it is possible to prevent soiling of the liquid receiving medium due to dirt becoming attached to the surface of the liquid receiving medium. It is possible to control cleaning in such a manner that the liquid removal device is cleaned whenever liquid removal (solvent removal) is performed, or the liquid removal device may be cleaned at fixed intervals, regardless of the solvent removal operation.

Preferably, the liquid ejection apparatus further comprises a recovery device which recovers the liquid received in the liquid removal device.

The recovery device may adopt a mode which absorbs the liquid from the liquid removal device by placing an absorbing member having higher liquid absorbability than the liquid removal device in contact with the liquid removal device, or a mode which suctions and removes the liquid from the liquid removal device by means of a suction device, such as a pump. Furthermore, a combination of these may be used.

Furthermore, the cleaning device and the recovery device described above may be composed in an integrated fashion. For example, it is also possible to provide a maintenance device which combines an integrated cleaning device and recovery device at a withdrawal position to which the liquid removal device is withdrawn when liquid removal is not being performed.

In order to attain the aforementioned object, the present invention is also directed to an inkjet recording apparatus, comprising the above-described liquid ejection apparatus.

If the above-described liquid ejection apparatus is used in the inkjet recording apparatus, then desirable liquid removal is performed in accordance with the image formed on the liquid receiving medium (recording medium, print medium). It is possible to prevent rear side transfer of ink on the liquid receiving medium, and image soiling caused by contact between the liquid removal device and the liquid receiving medium, and the image quality can be improved.

Preferably, the liquid ejection head comprises: an ink ejection head which ejects ink which forms an image onto the liquid receiving medium; and a treatment liquid ejection head which ejects treatment liquid which causes the ink to fix on the liquid receiving medium by reacting with the ink.

In a two-liquid type of inkjet recording apparatus which promotes the fixing of the ink by causing a treatment liquid to react with the ink, unreacted ink (ink solvent) and surplus treatment liquid is removed, and therefore, improved drying efficiency of the liquid receiving medium (recording medium, print medium) can be expected and therefore it is possible to prevent cockling on the recording medium. Particularly beneficial effects can be obtained in a two-liquid type of inkjet recording apparatus which ejects a large volume of liquid (solvent) onto the liquid receiving medium.

In order to attain the aforementioned object, the present invention is also directed to a liquid removal method for a liquid ejection apparatus which ejects liquid onto a liquid receiving medium, the method comprising the steps of: ejecting liquid onto a liquid receiving medium; determining a volume of the liquid ejected on the liquid receiving medium; removing the liquid on the liquid receiving medium by causing a liquid removal device to make contact with the liquid on the liquid receiving medium, in accordance with the volume of the liquid determined in the determining step; and after the removing step, moving the liquid removal device in a direction substantially perpendicular to a liquid receiving surface of the liquid receiving medium, in such a manner that the liquid removal device is not in contact with the liquid on the liquid receiving medium.

According to the present invention, the distance between the liquid ejection device and the liquid receiving medium is controlled in such a manner that the liquid removal device which removes liquid on the liquid receiving medium makes contact with the liquid on the liquid receiving medium when performing liquid removal, and the liquid removal device does not make contact with the liquid on the liquid receiving medium when not performing liquid removal. Therefore, it is possible to extend the lifespan of the liquid removal device, as well as preventing soiling of the liquid receiving medium due to contact between the liquid removal device and the liquid receiving medium.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 8 is a diagram showing a threshold value table which uses the ejection volume as a reference;

FIG. 9 is a diagram showing a threshold value table which uses the solvent volume as a reference;

FIG. 10 is a diagram showing a correction coefficient table;

DETAILED DESCRIPTION OF THE PREFERRED EMBODIMENTS

General Composition of Inkjet Recording Apparatus

Figure 1:
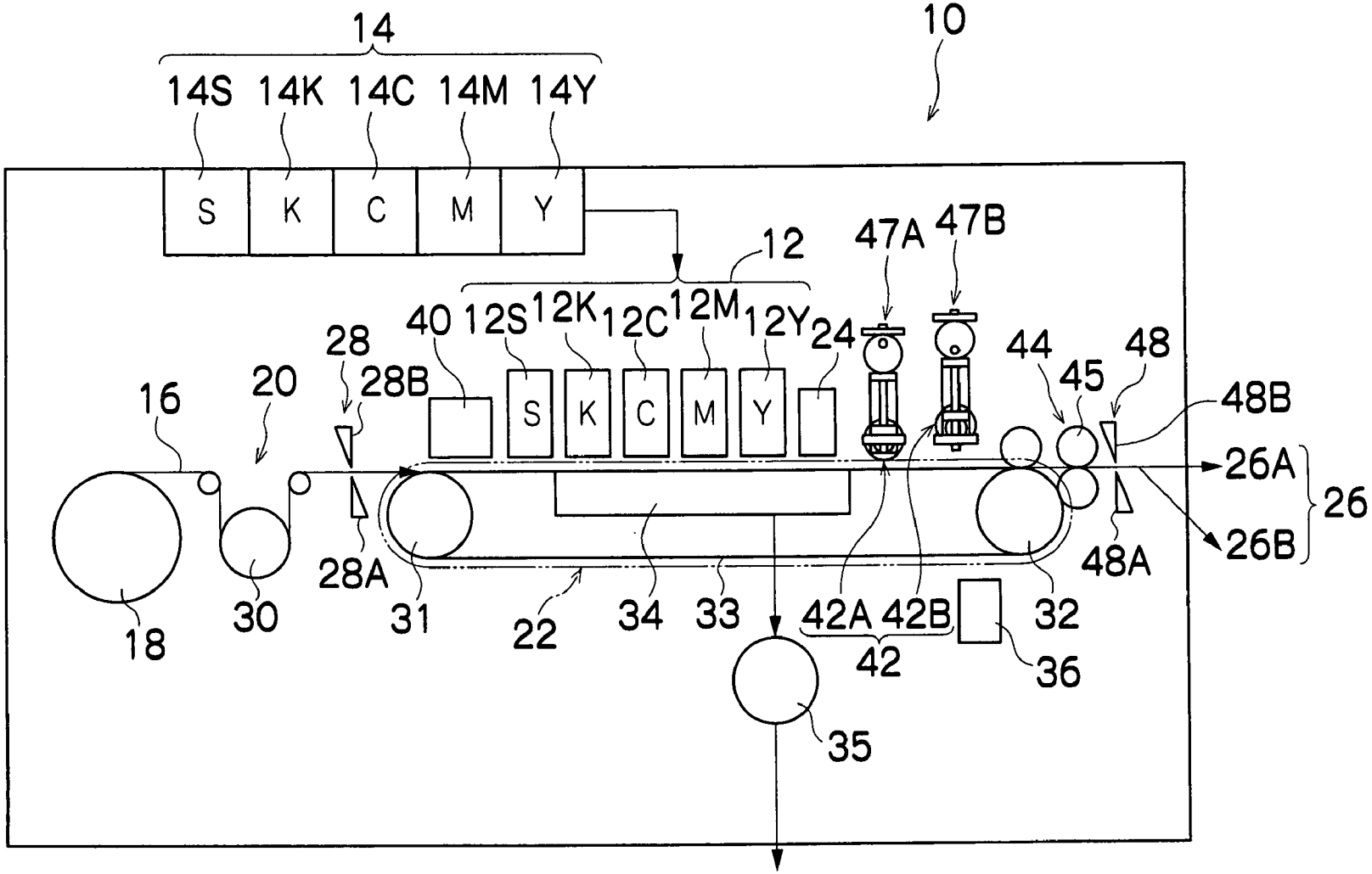
FIG. 1 is a general schematic drawing of an inkjet recording apparatus according to an embodiment of the present invention.

FIG. 1 is a diagram of the general composition of an inkjet recording apparatus according to an embodiment of the present invention. As shown in FIG. 1, the inkjet recording apparatus 10 comprises: a print unit 12 having a plurality of print heads 12K, 12C, 12M and 12Y provided for respective inks of the colors black (K), cyan (C), magenta (M) and yellow (Y); a treatment liquid ejection head 12S, which ejects treatment liquid reacting with the ink, arranged in a stage prior to the print heads 12K, 12C, 12M and 12Y (hereinafter, the print heads 12K, 12C, 12M and 12Y and the treatment liquid ejection head 12S are referred to generally as the heads 12S, 12K, 12C, 12M and 12Y); a storing and loading unit 14, which stores the ink to be supplied to the print heads 12K, 12C, 12M and 12Y of the respective colored inks, and the treatment liquid to be supplied to the treatment liquid ejection head 12S; a paper supply unit 18, which supplies recording paper 16 forming a recording medium; a decurling unit 20, which removes curl in the recording paper 16; a suction belt conveyance unit 22, disposed opposing the ink ejection surface of the print unit 12, which conveys recording paper 16 while keeping the recording paper 16 flat; a print determination unit 24, which reads out the print result created by the print unit 12; and a paper output unit 26, which outputs printed recording paper 16 (printed matter).

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter (a first cutter) 28 is provided as shown in FIG. 1, and the continuous paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the side adjacent to the printed surface across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the ink (treatment liquid) ejection face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor 88 (not shown in FIG. 1, but shown in FIG. 6) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance, in which nothing comes into contact with the image surface in the printing area (ejection area) where the heads 12S, 12K, 12C, 12M, and 12Y face the recording paper 16 and the recording paper 16 receives droplets of the treatment liquid and the ink, is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
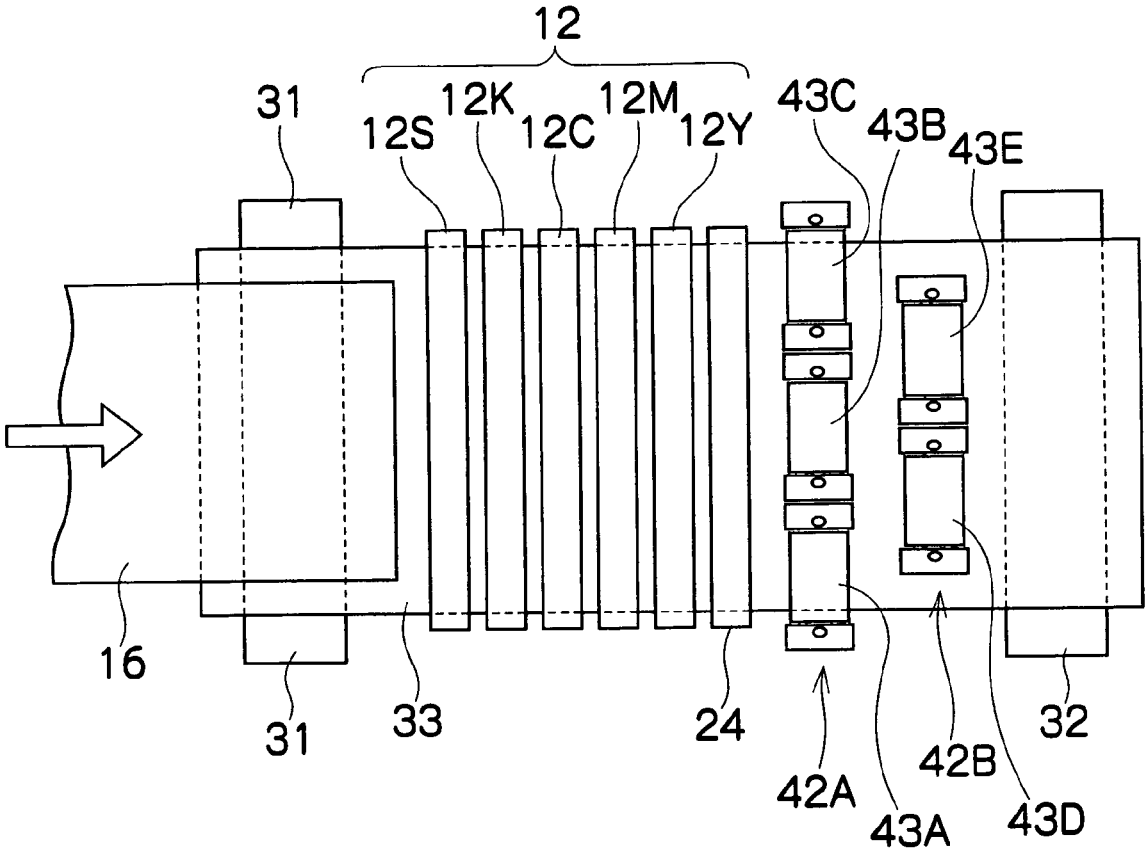
FIG. 2 is a principal plan diagram of the peripheral area of a print unit in the inkjet recording apparatus illustrated in FIG. 1.

The print unit 12 is a so-called "full line head" in which a line head having a length corresponding to the maximum paper width is arranged in a direction that is perpendicular to the paper feed direction (see FIG. 2). An embodiment of the detailed structure is described later, and each of the heads 12S, 12K, 12C, 12M, and 12Y is constituted by a line head, in which a plurality of nozzles are arranged along a length that exceeds at least one side of the maximum-size recording paper 16 intended for use in the inkjet recording apparatus 10, as shown in FIG. 2.

The treatment liquid ejection head 12S corresponding to the treatment liquid (S) and the print heads 12K, 12C, 12M, and 12Y corresponding to the respective colored inks are arranged in the order of treatment liquid (S), black (K), cyan (C), magenta (M), and yellow (Y) from the upstream side, following the feed direction of the recording paper 16 (hereinafter, referred to as the paper feed direction). A color print can be formed on the recording paper 16 by ejecting treatment liquid from the treatment liquid ejection head 12S and by ejecting colored inks from the print heads 12K, 12C, 12M, and 12Y, respectively, onto the recording paper 16 while conveying the recording paper 16.

The print unit 12, in which the full-line heads covering the entire width of the paper are thus provided for the treatment liquid and the respective ink colors, can form an image over the entire surface of the recording paper 16 by performing the action of moving the recording paper 16 and the print unit 12 relative to each other in the sub-scanning direction just once (in other words, by means of a single sub-scan). Higher-speed printing is thereby made possible and productivity can be improved in comparison with a shuttle type head configuration in which a head moves reciprocally in the main scanning direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the storing and loading unit 14 comprises a treatment liquid tank 14S corresponding to the recording liquid ejection head 12S, and ink supply tanks 14K, 14C, 14M and 14Y, which store colored inks corresponding to the respective print heads 12K, 12C, 12M, 12Y. The tanks are connected to the heads 12S, 12K, 12C, 12M and 12Y, through prescribed tubing channels (not shown).

Furthermore, the ink storing and loading unit 14 also comprises a warning device (for example, a display device or an alarm sound generator) for warning when the remaining amount of any ink is low, and has a mechanism for preventing loading errors between inks of different colors and between the inks and treatment liquid.

The print determination unit 24 has an image sensor for capturing an image of the print result of the printing unit 12, and functions as a device to check for ejection defects such as clogs of the nozzles in the printing unit 12 from the print image evaluated by the image sensor.

The print determination unit 24 of the present embodiment is configured with at least a line sensor having rows of photoelectric transducing elements with a width that is greater than the treatment liquid- and ink-droplet ejection width (printable width) of the heads 12S, 12K, 12C, 12M, and 12Y This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the respective head 12S, 12K, 12C, 12M, and 12Y, and the ejection of each head 12S, 12K, 12C, 12M, and 12Y is determined. The ejection determination includes the presence of the ejection, measurement of the dot size, and measurement of the dot deposition position.

A solvent removal unit 42, which removes the residual un-reacted treatment liquid and ink solvent that remain on the recording paper 16, is disposed at a stage after the print determination unit 24 (on the downstream side thereof in terms of the paper feed direction). In the present embodiment, the treatment liquid (solvent of the treatment liquid) and the ink solvent are generally referred to simply as solvent.

The solvent removal unit 42 comprises two absorbing roller modules 42A and 42B disposed following the paper feed direction (sub-scanning direction) (in other words, the solvent removal unit 42 has a structure divided into two parts in the paper feed direction). The absorbing roller modules 42A and 42B have a plurality of absorbing rollers 43A to 43E (liquid removal device, not shown in FIG. 1, but shown in FIG. 2) aligned in the sub-scanning direction, which is substantially perpendicular to the paper feed direction. In other words, the absorbing roller has a structure divided into parts in a direction substantially perpendicular to the paper feed direction.

In FIG. 2, the absorbing roller module 42A situated on the upstream side in the paper feed direction has three absorbing rollers 43A, 43B and 43C, and the absorbing roller module 42B situated on the downstream side in the paper feed direction has two rollers 43D and 43E. These absorbing rollers 43 (43A to 43E) are disposed in a staggered fashion, in mutually displaced positions in the sub-scanning direction.

In other words, when the absorbing rollers 43A to 43E are projected to an alignment in the sub-scanning direction, the rollers are aligned in the order, absorbing roller 43A, absorbing roller 43D, absorbing roller 43B, absorbing roller 43E, and absorbing roller 43C, sequentially, from the lower side end in FIG. 2, the absorbing roller 43D being disposed in a position where it overlaps partially with the absorbing roller 43A and the absorbing roller 43B, and the absorbing roller 43E being disposed in a position where it overlaps partially with the absorbing roller 43B and absorbing roller 43C.

More specifically, in the solvent removal unit 42, the absorbing roller module 42B is disposed in a position where it complements the absorbing roller module 42A, and by using both of these absorbing roller modules 42A and 42B, it is possible to remove solvent from the whole of the printable width of the recording paper 16.

The absorbing rollers 43 may be made from a cloth, hydrophilic porous member, polyvinylalcohol (PVA), polyurethane material, or the like. Of course, instead of the absorbing rollers 43, it is also possible to provide a flat plate-shaped absorbing member, or an absorbing member having a web-shaped surface which makes contact with the solvent.

As shown in FIG. 1, the absorbing roller module 42A comprises an elevator mechanism 47A (movement device) which raises and lowers the absorbing rollers 43A, 43B and 43C independently, and the absorbing roller module 42B comprises an elevator mechanism 47B (movement device) which raises and lowers the absorbing rollers 43D and 43E independently.

By independently raising and lowering each of the absorbing rollers 43A to 43E by means of the elevator mechanisms 47 (47A and 47B), it is possible to vary each of the clearances between the absorbing rollers 43A to 43E and the print surface of the recording paper 16.

In the present inkjet recording apparatus 10, when performing solvent removal, the absorbing rollers 43A to 43E are placed in contact with the solvent, and when not performing solvent removal, the absorbing rollers 43A to 43E are withdrawn to a position where they do not make contact with the solvent. When performing solvent removal, the absorbing rollers 43 are placed in contact with the solvent on the recording paper 16, and desirably, in order to remove the solvent reliably, the absorbing rollers 43 are abutted against (placed in contact with) the print surface of the recording paper 16, at a prescribed contact pressure. In order to raise the solvent absorbing efficiency, it is possible to reduce the conveyance speed of the recording paper 16.

If the contact pressure is increased, then it is possible to raise the solvent absorption efficiency, but this raises the possibility of the ink coloring material becoming attached to the surface of the absorbing rollers 43. Consequently, the pressure is controlled in order to achieve a suitable balance between the solvent absorption efficiency and the possibility of the ink coloring material becoming attached to the solvent absorbing rollers 43, by varying this contact pressure.

Since the plurality of absorbing rollers 43A to 43E are composed in an independently raisable and lowerable fashion, then it is possible to carry out solvent removal by means of each of the absorbing rollers 43A to 43E individually.

One embodiment of an elevator mechanism 47 is a mode which comprises a rail, an eccentric cam, a spring which impels the eccentric cam, and the like. The details of the control of the elevator mechanism 47 are described later.

The present embodiment shows the mode in which the solvent removal unit 42 comprises the five absorbing rollers 43A to 43E, but the number of absorbing rollers 43 may be four or fewer (and two or more), or it may be six or more. Furthermore, the mode is shown in which the absorbing rollers 43A to 43E are disposed in a staggered configuration, but the positioning of the absorbing rollers 43 is not limited to a staggered configuration, and it is also possible to employ an arrangement other than this, provided that it covers the full width of the printable region.

A heating and pressurizing unit 44 is provided at a stage following the solvent removal unit 42. The heating and pressurizing unit 44 is a device which dries the recording paper 16 and serves to control the luster of the image surface, and it applies pressure to the image surface by means of pressure rollers 45 having prescribed surface indentations, while heating same, and hence an undulating form is transferred to the image surface.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The printed matter generated in this manner is outputted from the paper output unit 26. The target print and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Head

Next, the structure of heads, 12S, 12K, 12C, 12M and 12Y is described. The heads 12S, 12K, 12C, 12M and 12Y have the same structure, and a reference numeral 50 is hereinafter designated to any of the heads.

Figure 3A:
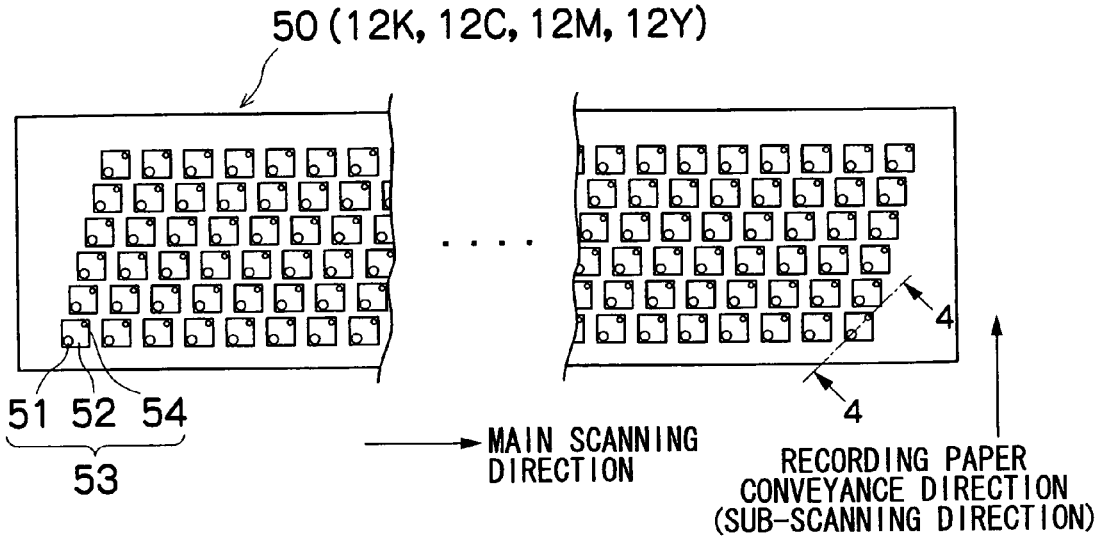
FIGS. 3A to 3C are plan view perspective diagrams showing an embodiment of the composition of an ejection head.
Figure 3B:
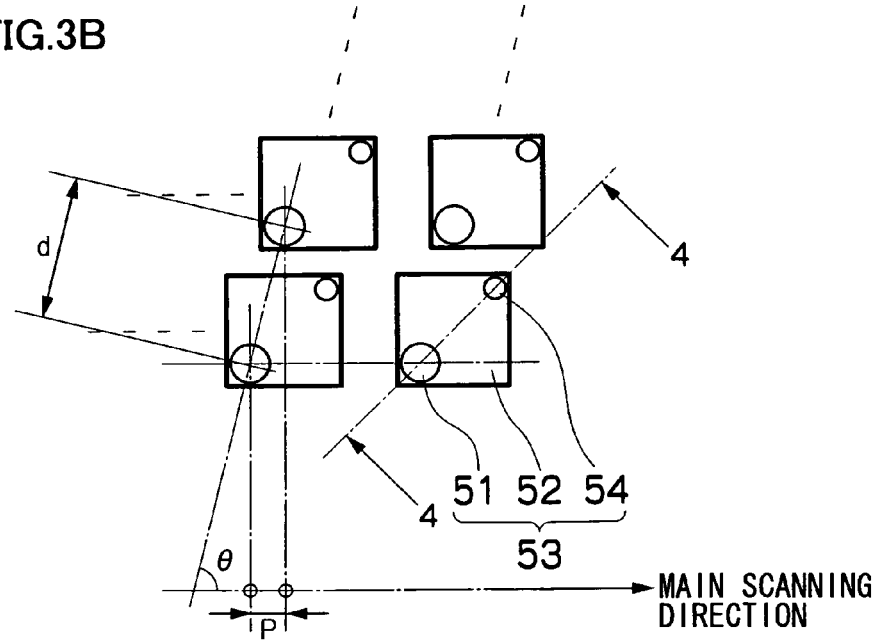
Figure 3C:
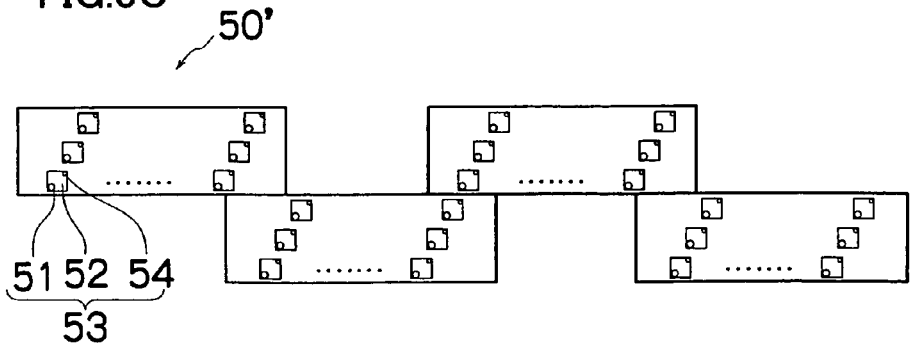
Figure 4:
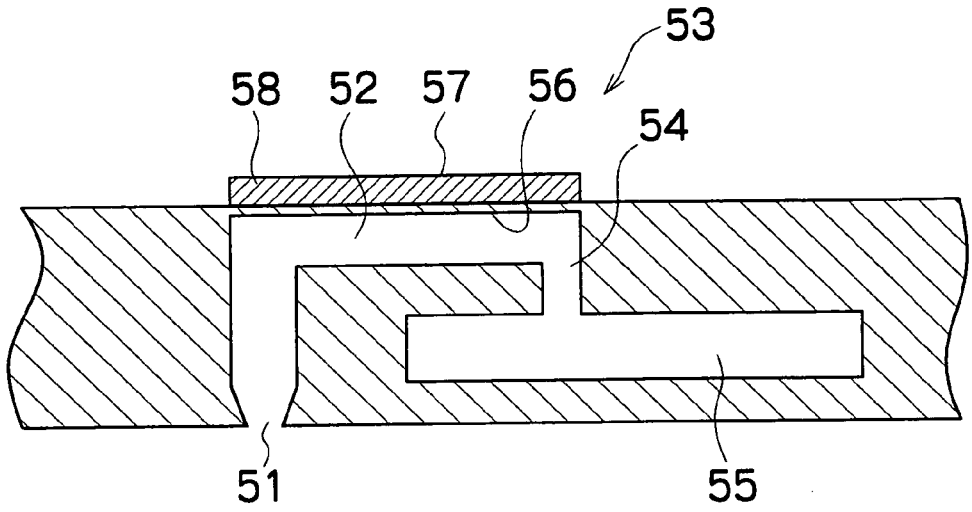
FIG. 4 is a cross-sectional view along line 4-4 in FIGS. 3A and 3B.

FIG. 3A is a plan view perspective diagram showing an embodiment of the structure of the head 50, and FIG. 3B is an enlarged diagram of a portion of same. Furthermore, FIG. 3C is a plan view perspective diagram showing a further embodiment of the composition of the head 50, and FIG. 4 is a cross-sectional diagram showing a three-dimensional composition of a liquid (ink or treatment liquid) chamber unit (being a cross-sectional view along line 4-4 in FIGS. 3A and 3B). In order to achieve a high resolution of the dots printed onto the surface of the recording medium, it is necessary to achieve a high density of the nozzles in the head 50. As shown in FIGS. 3A to 4, the head 50 in the present embodiment has a structure in which a plurality of liquid chamber units 53 including nozzles 51 for ejecting liquid droplets and pressure chambers 52 connecting to the nozzles 51 are disposed in the form of a staggered matrix, and the effective nozzle pitch is thereby made small.

More specifically, as shown in FIGS. 3A and 3B, the head 50 according to the present embodiment is a full-line head having one or more nozzle rows in which the plurality of nozzles 51 for ejecting liquid are arranged through a length corresponding to the entire width (printable width) of the recording paper 16 in a direction substantially perpendicular to the paper feed direction.

Moreover, as shown in FIG. 3C, it is also possible to use respective heads 50' of nozzles arranged to a short length in a two-dimensional fashion, and to combine same in a zigzag arrangement, whereby a length corresponding to the full width of the recording medium is achieved.

As shown in FIG. 4, the planar shape of the pressure chamber 52 provided for each nozzle 51 is substantially a square, and the nozzle 51 and the supply port 54 are disposed in both corners on a diagonal line of the square.

An actuator 58 provided with an individual electrode 57 is bonded to a pressure plate (diaphragm) 56, which forms the upper faces of the pressure chambers 52. When a drive voltage is applied between a common electrode, which is combined with the pressure plate 56, and the individual electrode 57, the actuator 58 deforms, thereby changing the volume of the pressure chamber 52. This causes a pressure change which results in liquid being ejected from the nozzle 51. When liquid is ejected, new liquid is supplied to the pressure chamber 52 from the common flow channel 55 through the supply port 54. A piezoelectric body (piezoelectric element), such as a piezo element, is suitable as the actuator 58. Furthermore, the structure of the liquid chamber unit 53 shown in FIG. 4 is merely one embodiment, and it is of course also possible to use another structure.

As shown in FIGS. 3A and 3B, the plurality of liquid chamber units 53 having this structure are composed in a lattice arrangement, based on a fixed arrangement pattern aligned in a main scanning direction, which is the lengthwise direction of the head 50, and an oblique direction which, rather than being perpendicular to the main scanning direction, is inclined at a fixed angle of $\theta$ with respect to the main scanning direction. By adopting a structure wherein a plurality of liquid chamber units 53 are arranged at a uniform pitch d in a direction having an angle $\theta$ with respect to the main scanning direction, the pitch P of the nozzles when projected to an alignment in the main scanning direction is $d \times \cos\theta$.

More specifically, the arrangement can be treated equivalently to one in which the respective nozzles 51 are arranged in a linear fashion at uniform pitch P, in the main scanning direction. By means of this composition, it is possible to achieve a nozzle composition of high density, in which the nozzle columns projected to align in the main scanning direction reach a total of 2400 per inch (2400 nozzles per inch, 2400 dpi). Below, in order to facilitate the description, it is supposed that the nozzles 51 are arranged in a linear fashion at a uniform pitch (P), in the main scanning direction.

In implementing the present invention, the arrangement of the nozzles is not limited to that of the embodiment illustrated. Moreover, a method is employed in the present embodiment where a liquid droplet is ejected by means of the deformation of the actuator 58, which is typically a piezoelectric element; however, in implementing the present invention, the method used for discharging liquid is not limited in particular, and instead of the piezo jet method, it is also possible to apply various types of methods, such as a thermal jet method where the liquid is heated and bubbles are caused to form therein by means of a heat generating body such as a heater, liquid being ejected by means of the pressure applied by these bubbles.

Description of Ink Supply System and Treatment Liquid Supply System

Next, the treatment liquid supply system and the ink supply system of the inkjet recording apparatus 10 is described. In the present embodiment, the treatment liquid supply system and the ink supply system have the same basic composition, and are described with respect to the ink supply system shown in FIG. 5. Below, the treatment liquid supply system and the ink supply system may be referred to jointly as the "supply system".

Figure 5:
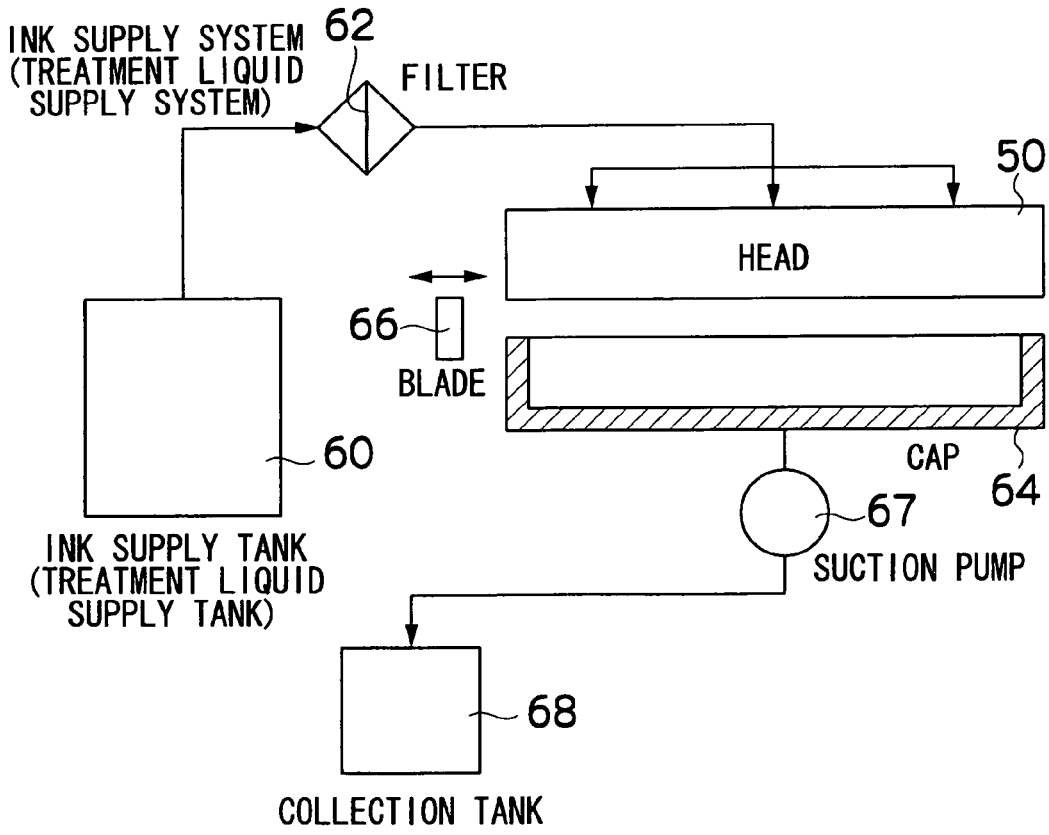
FIG. 5 is a principal block diagram showing the configuration of the supply system of the inkjet recording apparatus shown in FIG. 1.

FIG. 5 shows the composition of an ink supply system (or a treatment liquid supply system) provided in the inkjet recording apparatus 10. The ink supply system shown in FIG. 5 corresponds to the storing and loading unit 14 described in FIG. 1.

An ink supply tank (or a treatment liquid supply tank) 60 forming a base tank for supplying ink (or treatment liquid) is disposed in the ink supply system shown in FIG. 5. The ink supply tank 60 may adopt a system for replenishing ink by means of a replenishing opening (not illustrated), or a cartridge system wherein cartridges are exchanged independently for each tank, whenever the residual amount of ink has become low. If the type of ink is changed in accordance with the type of application, then a cartridge based system is suitable. In this case, desirably, type information relating to the ink is identified by means of a bar code, or the like, and the ejection of the ink is controlled in accordance with the ink type.

Furthermore, the ink in the ink supply tank 60 is supplied to the head 50 through prescribed tubing channels (not illustrated) after being passed through a filter 62 for removing foreign material and air bubbles. The filter mesh size in the filter 62 is preferably equivalent to or less than the diameter of the nozzle and is commonly about 20 μm.

Although not shown in FIG. 5, it is preferable to provide a sub-tank integrally to the head 50 or nearby the head 50. The sub-tank has a damper function for preventing variation in the internal pressure of the head 50 and a function for improving refilling of the head.

The inkjet recording apparatus 10 is also provided with a cap 64 as a device to prevent the nozzles 51 from drying out or to prevent an increase in the viscosity of the ink and the treatment liquid S in the vicinity of the nozzles 51, and a cleaning blade 66 as a device to clean the nozzle face.

A maintenance unit including the cap 64 and the cleaning blade 66 can be relatively moved with respect to the head 50 by a movement mechanism (not shown), and is moved from a predetermined holding position to a maintenance position below the head 50 as required.

The cap is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face is thereby covered with the cap.

During printing or standby, if the use frequency of a particular nozzle 51 is low, and if it continues in a state of not ejecting ink or treatment liquid S for a prescribed time period or more, then the solvent of the ink and the solvent of treatment liquid in the vicinity of the nozzle evaporates and the viscosity of the ink and the viscosity of the treatment liquid increases. In a situation of this kind, it will become impossible to eject ink or treatment liquid from the nozzle 51, even if the actuator 58 is operated.

Therefore, before a situation of this kind develops (while the ink or treatment liquid is within a range of viscosity which allows it to be ejected by operation of the actuator 58), the actuator 58 is operated, and a preliminary ejection ("purge", "blank ejection", "liquid ejection" or "dummy ejection") is carried out in the direction of the cap (ink receptacle), in order to expel the degraded ink or degraded treatment liquid (namely, the ink or treatment liquid in the vicinity of the nozzle which has increased in viscosity).

Furthermore, if air bubbles enter into the ink inside the head 50 (inside the pressure chamber 52), then even if the actuator 58 is operated, it will not be possible to eject ink from the nozzle. In a case of this kind, the cap is placed on the head 50, the ink containing air bubbles inside the pressure chamber 52 is removed by suction, by means of a suction pump 67, and the ink removed by suction is then sent to a collection tank 68.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink and treatment liquid inside the pressure chamber 52, the ink consumption is considerably large. Therefore, desirably, preliminary ejection is carried out when the increase in the viscosity of the ink is still minor.

The cleaning blade 66 is composed of rubber or another elastic member, and can slide on the ink ejection surface (surface of the nozzle plate) of the head 50 by means of a blade movement mechanism (wiper) which is not shown. When ink droplets or foreign matter has adhered to the nozzle plate, the surface of the nozzle plate is wiped and cleaned by sliding the cleaning blade 66 on the nozzle plate. When the ink ejection surface has been cleaned by the blade mechanism, preliminary ejection is performed in order to prevent foreign matters from entering the nozzle 51 by the blade.

Description of Control System

Figure 6:
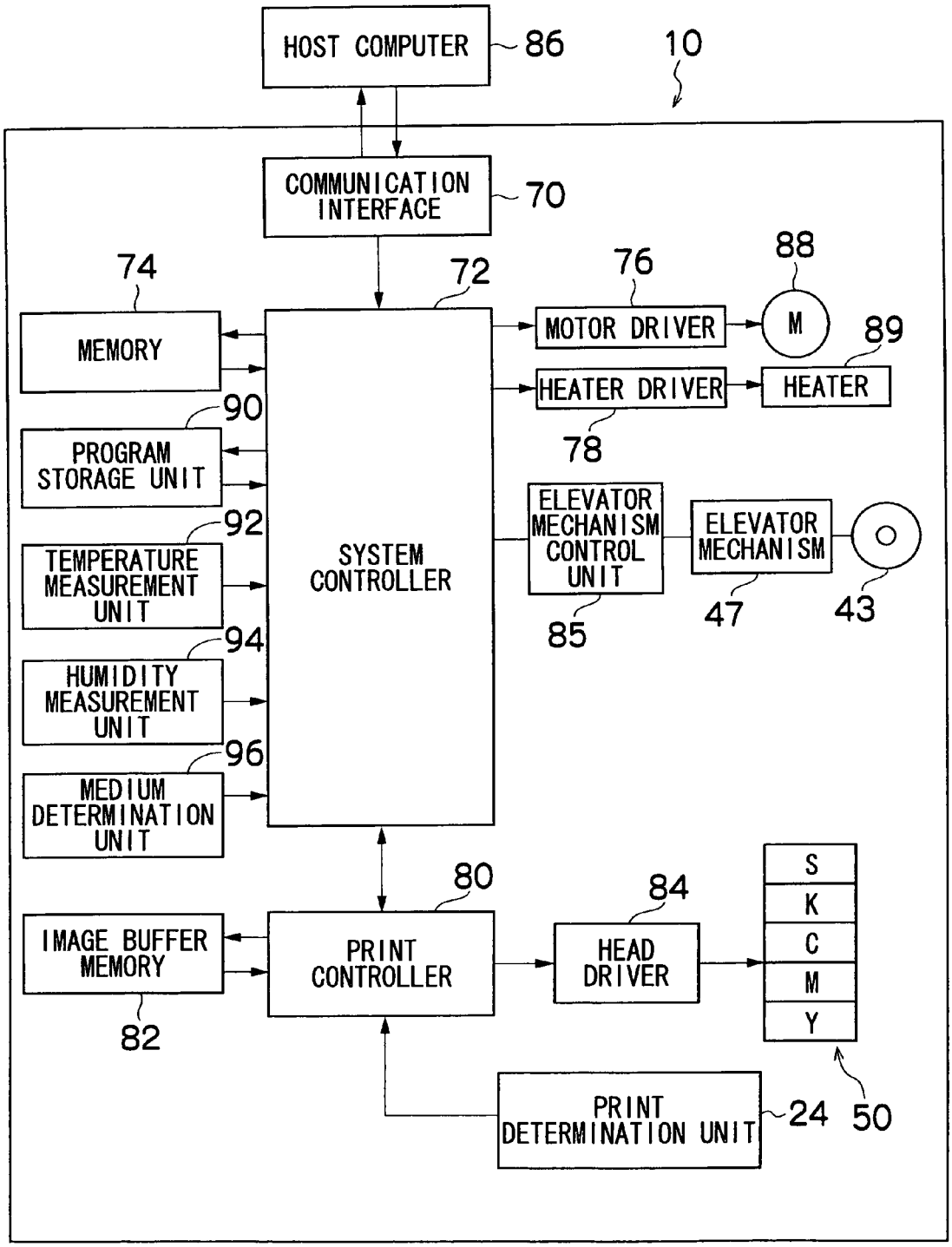
FIG. 6 is a principal block diagram showing the system configuration of the inkjet recording apparatus shown in FIG. 1.

FIG. 6 is a principal block diagram showing the system configuration of the inkjet recording apparatus 10. The inkjet recording apparatus 10 comprises a communication interface 70, a system controller 72, a memory 74, a motor driver 76, a heater driver 78, a print controller 80, an image buffer memory 82, a head driver 84, an elevator mechanism control unit 85, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the memory 74.

The memory 74 is a storage device for temporarily storing images inputted through the communication interface 70, and data is written and read to and from the memory 74 through the system controller 72. The memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, memory 74, motor driver 76, heater driver 78, elevator mechanism control unit 85, and the like, as well as controlling communications with the host computer 86 and writing and reading to and from the memory 74, and it also generates control signals for controlling the motor 88 and heater 89 of the conveyance system.

The motor driver 76 drives the motor 88 in accordance with commands from the system controller 72. The heater driver 78 drives the heater 89 of the post-drying unit 42 or the like in accordance with commands from the system controller 72.

The motor 88 shown in FIG. 6 includes a plurality of motors, such as a motor (motion actuator) which causes the roller 31 (32) of the suction belt conveyance unit 22 in FIG. 1 to rotate. Furthermore, the motor drivers 76 for controlling the plurality of motors 88 are provided to correspond with the motors. Of course, it is also possible to integrate a plurality of motor drivers onto a single chip.

The print controller 80 has a signal processing function for performing various tasks, compensations, and other types of processing for generating print control signals from the image data stored in the memory 74 in accordance with commands from the system controller 72 so as to supply the generated print data to the head driver 84. Prescribed signal processing is carried out in the print controller 80, and the ejection amount and the ejection timing of the ink and treatment liquid from the respective print heads 50 are controlled through the head driver 84.

The print controller 80 is provided with the image buffer memory 82; and image data, parameters, and other data are temporarily stored in the image buffer memory 82 when image data is processed in the print controller 80. The aspect shown in FIG. 6 is one in which the image buffer memory 82 accompanies the print controller 80; however, the memory 74 may also serve as the image buffer memory 82. Also possible is an aspect in which the print controller 80 and the system controller 72 are integrated to form a single processor.

The head driver 84, on the basis of print data supplied by the print controller 80, generates a drive signal and drives the actuators of the respective print heads of 12S, 12K, 12C, 12M and 12Y by the drive signal. The head driver 84 can be provided with a feedback control system for maintaining constant drive conditions for the print heads.

The elevator mechanism control unit 85 generates a drive signal on the basis of a control signal supplied by the system controller 72, and drives the motor (motion actuator) of the elevator mechanisms 47 on the basis of this drive signal.

The image data to be printed is inputted from an external source (the host computer 86, for example) through the communication interface 70, and is stored in the memory 74. In this stage, the RGB image data is stored in the memory 74.

The image data stored in the memory 74 is sent to the print controller 80 through the system controller 72, and is converted to the dot data for each ink color in the print controller 80. In other words, the print controller 80 performs processing for converting the inputted RGB image data into dot data for four colors, K, C, M and Y. The dot data generated by the print controller 80 is stored in the image buffer memory 82.

In the present embodiment, the memory 74 is shown as a storage unit attached to the system controller 72, but the memory 74 may also be constituted by a plurality of memories (storage media). Furthermore, it is also possible to incorporate the memory into the system controller 72. The information stored in the memory 74 may include, in addition to the RGB image data described above, various setting information, system parameters, a threshold value table used to judge conditions, various types of data tables, corrective coefficients used for various corrections, and the like.

Various control programs are stored in a program storage section 90, and a control program is read out and executed in accordance with commands from the system controller 72. The program storage section 90 may use a semiconductor memory, such as a ROM, EEPROM, or a magnetic disk, or the like. An external interface may be provided, and a memory card or PC card may also be used. Naturally, a plurality of these storage media may also be provided.

The program storage unit 90 may also be combined with a storage device (memory) (not illustrated) for storing operational parameters (system parameters), and the like.

The print determination unit 24 is a block that includes the line sensor as described above with reference to FIG. 1, reads the image printed on the recording paper 16, determines the ejection conditions (presence of the ejection, variation in the dot formation, and the like) by performing desired signal processing, or the like, and provides the determination results of the ejection conditions to the print controller 80.

According to requirements, the print controller 80 makes various corrections with respect to the head 50 on the basis of information obtained from the print determination unit 24.

The inkjet recording apparatus 10 comprises a temperature measurement unit 92 and a humidity measurement unit 94, which measure the ambient temperature and the ambient humidity of the head 50 and the recording paper 16 in the print region. A temperature signal indicating the temperature (temperature information) obtained by the temperature measurement unit 92, and a humidity signal indicating the humidity (humidity information) obtained by the humidity measurement unit 94 are sent to the system controller 72. The system controller 72 controls a temperature modification device, such as a heater 89, cooling fan (not illustrated), and the like, in such a manner that a prescribed (established) temperature and humidity are maintained on the basis of the temperature signal and the humidity signal.

Furthermore, the present inkjet recording apparatus 10 comprises a medium determination unit 96 for determining the type of recording paper (medium) used, and implements various types of control, such as a control of the ejection of treatment liquid and ink, temperature and humidity control of the head 50, and the like, in accordance with the type of medium determined by the medium determination unit 96. For example, a threshold value for ink solvent removal is established in accordance with the type of medium determined by the medium determination unit 96, and ink solvent removal is controlled on the basis of this threshold value. The details of ink solvent removal are described later.

In other words, a composition is adopted wherein, when the medium type information determined by the medium determination unit 96 is sent to the system controller 72, the system controller 72 controls the respective units on the basis of this medium type information.

The mode of determined the type of medium by means of the medium determination unit 96 may involve the operator inputting a desired medium type by means of a man-machine interface, such as a keyboard, touch panel, or the like, or alternatively, the type of medium may be determined by means of a determination device, such as the print determination unit 24. Moreover, it is also possible to judge the type of paper used automatically, by reading in, by means of a prescribed reading apparatus, information on an information recording body, such as a barcode or wireless tag, on which paper type information is recorded, attached to a magazine or tray holding the recording paper 16.

Description of Solvent Removal Control

Next, solvent removal control implemented in the inkjet recording apparatus 10 is described in detail. The inkjet recording apparatus 10 is composed in such a manner that solvent remaining on the recording paper 16 is removed, thereby preventing rear-side transfer or image deterioration occurring when the print surface of the recording paper 16 makes contact with other recording paper 16 after printing, as well as preventing cockling of the recording paper 16.

In the inkjet recording apparatus 10, the print region of the recording paper 16 (the image formation region on which the image is formed) is divided into a plurality of blocks, a judgment of whether or not to carry out solvent removal is made for each respective block, and control is implemented in such a manner that solvent removal is carried out in blocks where it is judged that solvent removal is required.

Figure 7:
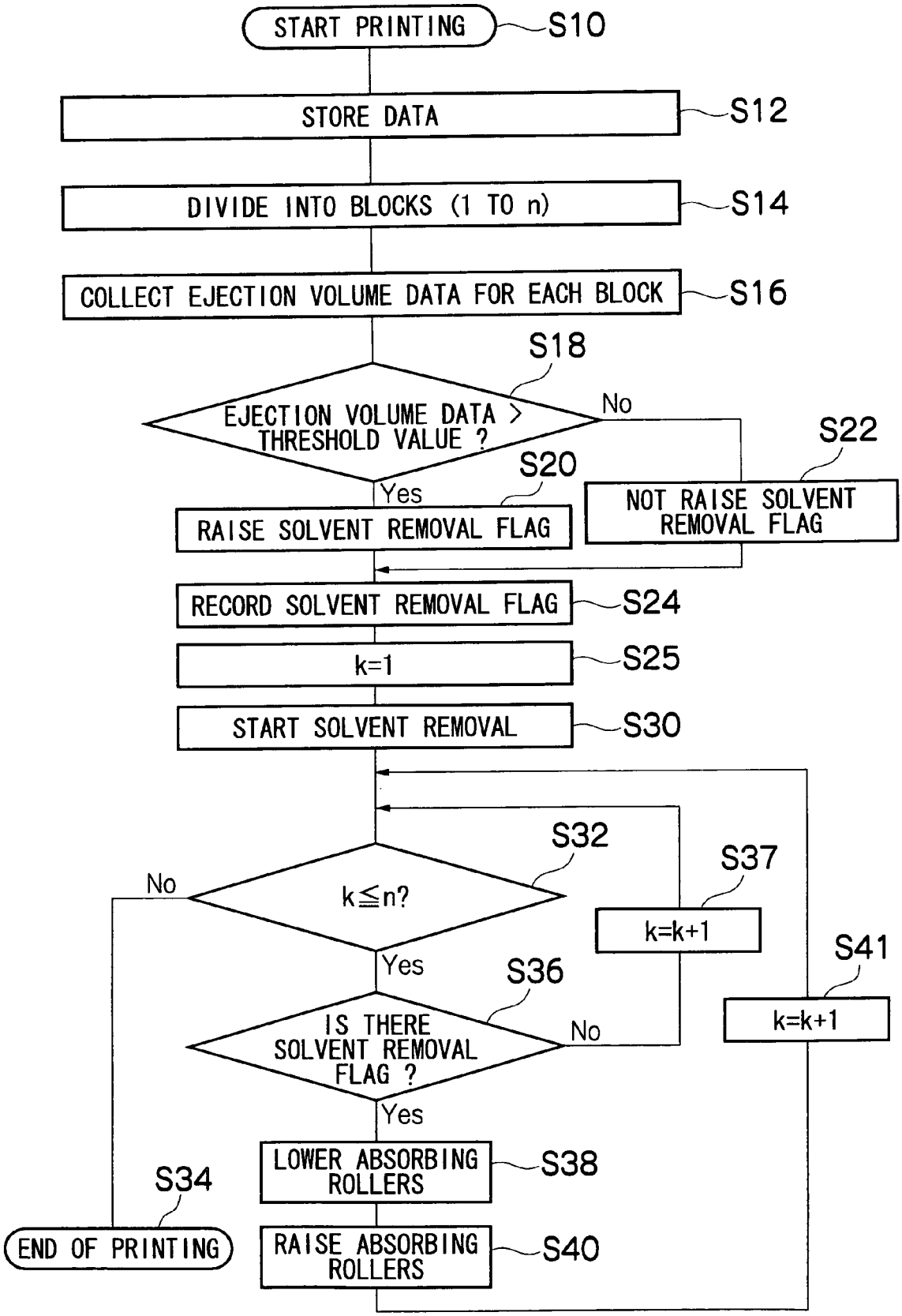
FIG. 7 is a flowchart showing a sequence of solvent removal control according to an embodiment of the present invention.

FIG. 7 is a flowchart showing a control sequence for solvent removal according to the present embodiment.

As shown in FIG. 7, when printing (image formation) starts (step S10), image data (RGB data) acquired by means of the communication interface 70 shown in FIG. 6 is stored in the memory 74 (step S12 in FIG. 7), and the image formation region of the recording paper 16 is divided into n blocks in the sub-scanning direction (where n is a natural number equal to 1 or above) (step S14).

Here, in the print controller 80 shown in FIG. 6, the ejection volume data for the treatment liquid and ink to be ejected from the respective heads 50 is collected from the RGB data stored in the memory 74 (hereinafter, this may be referred to simply as "ejection volume data") (step S16 in FIG. 7).

At this step S16, ejection volume data is collected for each of the blocks established on the recording paper 16, and the ejection volume data for all of the blocks is stored temporarily.

On the basis of the ejection volume data for each of the blocks, the ejection volume data is compared with a previously established threshold value (step S18), and a solvent removal flag is raised for a block in which the ejection volume data is greater than the threshold value (step S20), while the solvent removal flag is not raised for a block in which the ejection volume data is not greater than the threshold value (step S22).

When a judgment has been completed in this way for all of the blocks, the blocks for which the solvent removal flag has been established are stored (step S24), and furthermore, the header block is determined from the blocks for which the presence or absence of the solvent removal flag is to be judged, and k=1 is stored for that header block (step S25). The blocks for which the solvent removal flag has been raised (the mapped solvent removal flags) are stored in the memory 74 shown in FIG. 6, or the like.

When the solvent removal flags have been stored in this way, the solvent removal operation starts (step S30 in FIG. 7).

Firstly, at step S32 it is judged whether or not $k \leqq n$, for the k-th block for which the presence or absence of the solvent removal flag is to be judged, and if $k>n$ for that block (NO verdict), then the printing control is terminated (step S34).

On the other hand, if, at step S32, $k \leqq n$ for a block for which the ejection volume data has been collected (YES verdict), then the presence/absence of the solvent removal flag is judged for that block (step S36), and if it is judged that there is the solvent removal flag at step S36 (YES verdict), then the absorbing rollers 43 are lowered (step S38), and solvent removal is carried out for that block. When a prescribed time period has elapsed and a prescribed quantity of solvent has been removed from the block in question, then the procedure advances to step S40, and the elevator mechanism 47 is controlled in such a manner that the absorbing rollers 43 are raised (step S40), and k=k+1 is stored (step S41), whereupon the solvent removal control sequence advances to step S32.

On the other hand, at step S36, if it is judged that the solvent removal flag has not been raised for that block (NO verdict), then k=k+1 is stored (step S37), and the solvent removal control sequence advances to step S32.

In the solvent removal control sequence shown in FIG. 7, control is implemented in such a manner that the absorbing rollers 43 are raised and lowered by observing the solvent removal flags of the respective blocks (by on/off control of the absorbing rollers 43), but it is also possible to adopt the composition described below.

For example, if there are blocks situated continuously in the paper feed direction for which the solvent removal flag has been raised, then rather than switching the absorbing rollers 43 on and off for the respective blocks, the absorbing rollers 43 are switched on continuously (the absorbing rollers 43 are kept on).

It is also possible to implement control whereby, in a case where blocks for which the solvent removal flag has been raised are located in a continuous fashion, if there is not sufficient time to switch the absorbing rollers 43 off and then switch them on again, for example, then the absorbing rollers 43 are not switched off, even in the case of a block for which the solvent removal flag is not raised (in other words, the absorbing rollers 43 are left on).

Moreover, it is possible to process the k-th blocks in sequence, starting from k=1, and it is also possible to adopt a composition in which, for example, blocks arranged in a direction substantially perpendicular to the paper feed direction are processed in a parallel fashion.

Here, FIGS. 8 and 9 show examples of the threshold values (threshold value tables) used in step S 18. The permeation time of the treatment liquid and ink into the recording paper 16 is dependent on the relationship between the type of recording paper 16 and the types of treatment liquid and ink. In the inkjet recording apparatus 10, a plurality of threshold values corresponding to a plurality of recording papers 16 are stored in the threshold value table.

FIG. 8 shows threshold values specified according to the treatment liquid ejection volume and the ink ejection volume corresponding to types of media (recording paper 16).

As shown in FIG. 8, with PPC (plain paper copier) paper, it is judged that solvent removal is necessary if the total of the ejection volume of treatment liquid plus the ejection volume of ink exceeds 8 $ml/m^2$. Furthermore, solvent removal is judged to be necessary if the total ejection volume exceeds 5 $ml/m^2$, in the case of art paper or coated paper, or 25 $ml/m^2$ in the case of inkjet (IJ) photographic paper. Moreover, in the case of non-permeable media (a resin sheet, or the like), the threshold value is set to 0 $ml/m^2$ and control is implemented in such a manner that solvent removal is always carried out in the region where the treatment liquid and ink are ejected.

Since the treatment liquid ejection volume and the ink ejection volume include the treatment liquid and ink solutes (coloring material, and the like), it is more desirable to use the total of the solvent volume in the treatment liquid and the solvent volume in the ink as a reference. Here, the "solvent" includes polyhydric alcohol, additives, and the like, which are contained in the treatment liquid or ink, but it excludes the coloring material contained in the ink.

FIG. 9 shows the threshold values (threshold value table) designated in accordance with the solvent volume of the treatment liquid and the solvent volume of the ink. As shown in FIG. 9, the threshold values based on the solvent volume are smaller values than those based on the ejection volume shown in FIG. 8.

FIGS. 8 and 9 show threshold values corresponding to four types of media, but it is also possible to provide threshold values corresponding to other types of media. These threshold value tables are stored in the memory 74 shown in FIG. 6.

Moreover, the permeation time of treatment liquid and ink into the recording paper 16 are dependent on the temperature and humidity in the periphery of the head 50 (the recording paper 16 and the peripheral region of the recording paper 16). More specifically, in a low-temperature environment or a high-humidity environment, the treatment liquid solvent and ink solvent are liable to hardly evaporate, and therefore, the threshold values are lowered.

In the inkjet recording apparatus 10, the threshold values are corrected by referring to the correctional coefficient table shown in FIG. 10, on the basis of the temperature information and the humidity information obtained by a sensing operation of the temperature measurement unit 92 and the humidity measurement unit 94 shown in FIG. 6. Consequently, corrected threshold values are specified. These corrected threshold values are used as a basis for judging whether or not solvent removal is to be carried out at step S22 shown in FIG. 7.

As shown in FIG. 10, if the temperature is less than 10° C. and the humidity is less than 20%, the correction coefficient is 1 (in other words, the threshold value is uncorrected), and similarly, if the temperature is 10° C. or above and less than 30° C. and the humidity is 20% or above and less than 50%, or the temperature is 30° C. or above and the humidity is 50% or above, then the correction coefficient is 1. Taking the conditions for the correction coefficient of 1 as a reference point, a correction coefficient which exceeds 1 is specified in order that the threshold value becomes greater when the temperature rises, and a correction coefficient which is less than 1 is specified in order that the threshold value becomes smaller when the humidity rises.

The correction coefficient table shown in FIG. 10 is merely one embodiment, and the temperature conditions and humidity conditions may be specified in greater detail.

Figure 11:
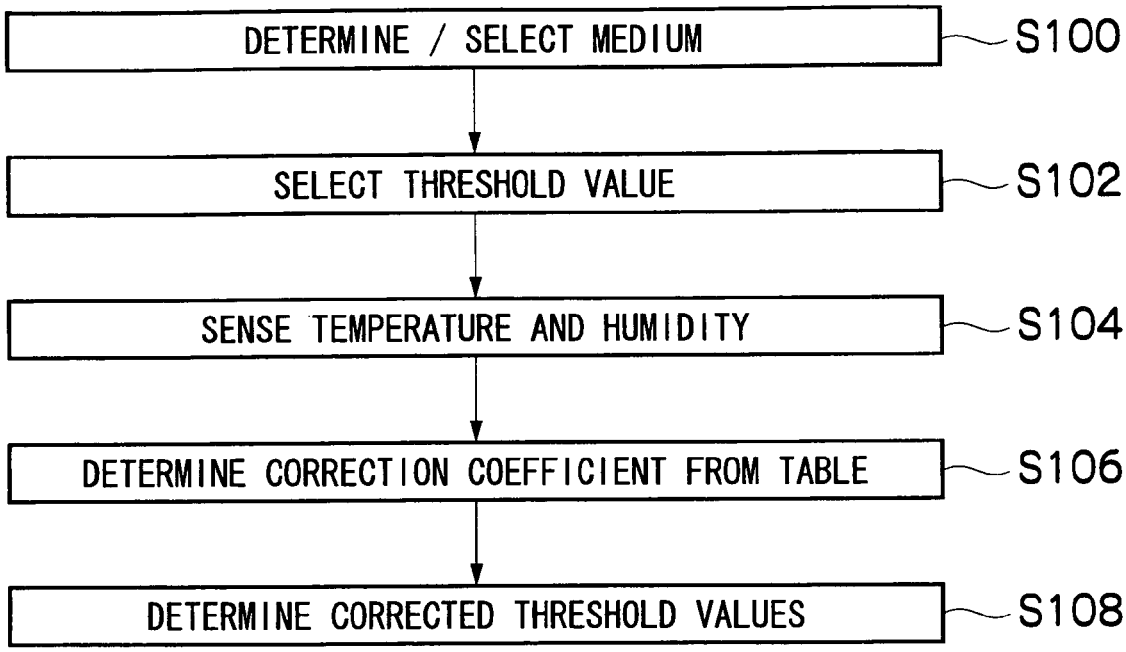
FIG. 11 is a flowchart showing the sequence of control for correcting the threshold value.

FIG. 11 shows a flowchart which represents the sequence of control for determining the aforementioned corrected threshold values.

As shown in FIG. 11, when the type of recording paper 16 (medium) is determined (step S100), the threshold value corresponding to the type of determined recording paper 16 is read out from the memory 74 (step S102).

On the other hand, temperature information is acquired from the temperature measurement unit 92 shown in FIG. 6, and furthermore, humidity information is acquired from the humidity measurement unit 94 (step S104 in FIG. 11).

When the temperature information and humidity information acquired at step S104 has been gathered, the correction coefficient is specified from the correction coefficient table shown in FIG. 10 (step S106), and corrected threshold values obtained by multiplying the threshold values read out from the memory 74 by the correction coefficient specified at step S106 are determined (step S108).

In this way, the threshold values used to judge whether or not to carry out solvent removal are changed in accordance with the type of recording paper 16 and the temperature and humidity in the peripheral region of the head 50 (the recording paper 16), and therefore, solvent removal is optimized in accordance with print conditions, such as the type of recording paper 16, the temperature and humidity. Consequently, improved print quality can be expected, while at the same time, the drying efficiency of the heating and pressurization unit 44 provided to the downstream side of the solvent removal unit 42 can be improved (the load on this unit can be reduced).

Next, a specific control embodiment is described in which the recording paper 16 is divided into a plurality of blocks, and it is judged whether or not to carry out solvent removal for each block unit.

Figure 12:
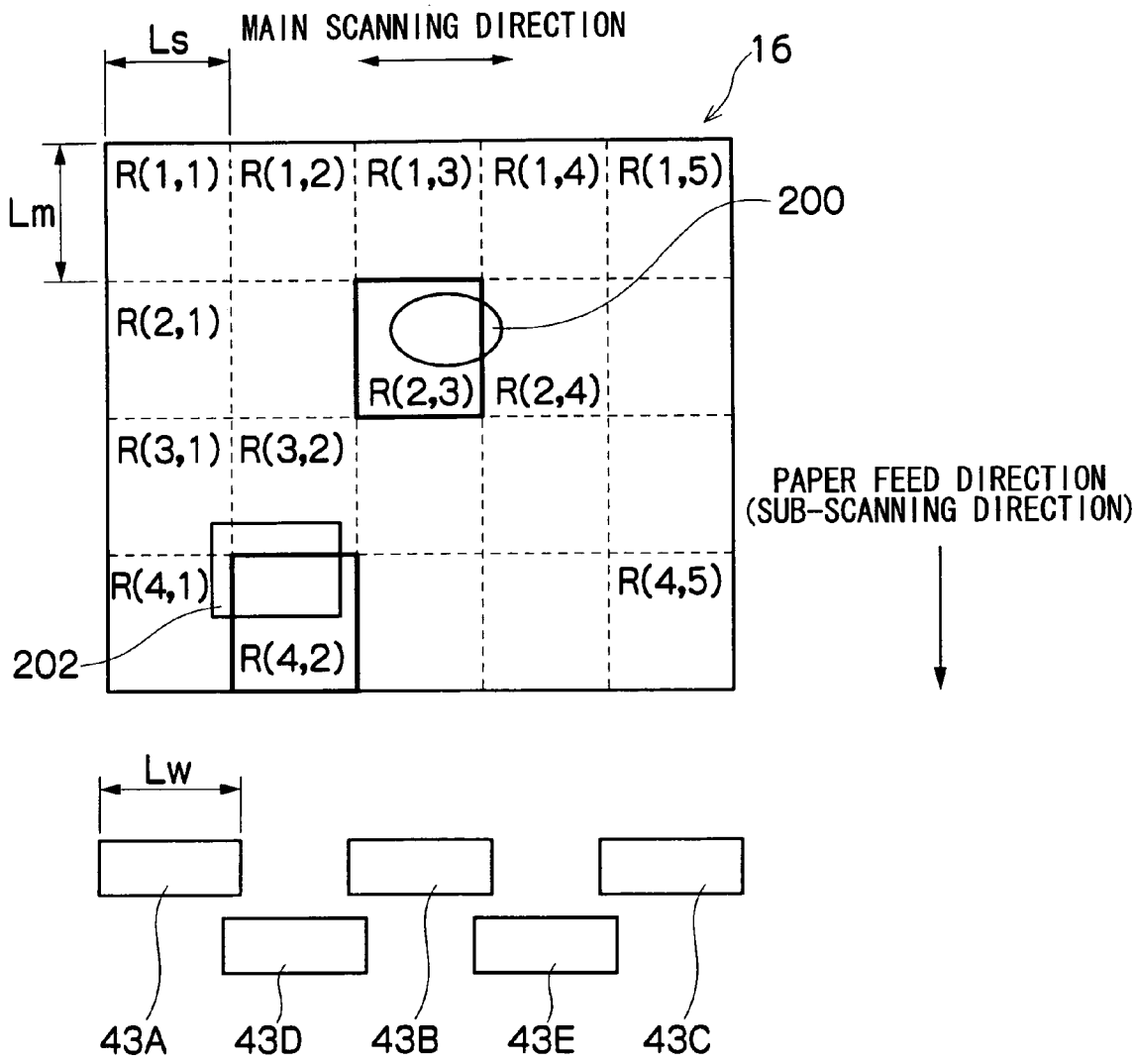
FIG. 12 is a diagram showing the specification of regions corresponding to the width of the absorbing rollers.

FIG. 12 shows a mode in which the recording paper 16 is divided into blocks corresponding to the widths of the absorbing rollers 43A to 43E. In the embodiment shown in FIG. 12, the widths (the lengths in the main scanning direction) Lw of the absorbing rollers 43A to 43E are the same.

As shown in FIG. 12, twenty blocks R(1,1) to R(4,5) each having a length of Ls in the main scanning direction and a length of Lm in the sub-scanning direction are defined on the recording paper 16. The length Ls of each block R in the main scanning direction is set in accordance with the width Lw of the absorbing rollers 43. In the present embodiment, Ls is set to be smaller than Lw, in consideration of overlaps between the absorbing rollers 43.

On the other hand, the length Lm in the sub-scanning direction of the blocks R(1,1) to R(4,5) is set from the viewpoint of cockling. A composition may be adopted in such a manner that this length Lm has a single value, regardless of the type of recording paper 16, but it is also possible to achieve highly accurate solvent removal by altering the value of Lm in accordance with the type of recording paper 16.

In other words, control is implemented in such a manner that that Lm is reduced in the case of art papers or coated papers which are liable to produce cockling (rapid permeation of the solvent), whereas the value of Lm is increased in the case of inkjet photographic papers, which are not liable to produce cockling. In order to change the length Lm in the sub-scanning direction of the aforementioned regions R(1,1) to R(4,5), it is possible to alter the conveyance speed of the recording paper 16, or to alter the time period during which the absorbing rollers 43 make contact with the recording paper 16 (i.e., the liquid on the surface of the recording paper 16).

In the present embodiment, if art paper is used as the recording paper 16, then the conveyance speed of the recording paper 16 and the time period during which the absorbing rollers 43 make contact with the liquid are controlled in such a manner that Lm=20 mm.

On the recording paper 16 shown in FIG. 12, a picture 200 (indicated by the approximate oval shape) is formed in such a manner that it extends over blocks R(2,3) and R(2,4), and furthermore, a picture 202 (indicated by the approximate rectangular shape) is formed in such a manner that it extends over blocks R(3,1), R(3,2), R(4,1) and R(4,2).

Here, the "picture" represents a photograph, picture, or the like, which has a large ejection volume of the treatment liquid and ink, compared to text, diagrams, line drawings, or the like.

The total ejection volume data of the treatment liquid ejection volume data plus the ink ejection volume data is gathered for each block. If the block R(2,3) has a total ejection volume data that is greater than the previously determined threshold value, then the solvent removal flag is raised for the block R(2,3). If the block R(4,2) has a total ejection volume data that is greater than the previously determined threshold value, then the solvent removal flag is raised for the block R(4,2).

When the block for which the solvent removal flag has been raised reaches the solvent removal region (the region where solvent is removed by the solvent removal unit 42), then the absorbing roller 43 corresponding to that block makes contact with the recording paper 16, and solvent removal is performed.

As shown in FIG. 12, by determining the size of the blocks R established on the recording paper 16 in accordance with the width of the absorbing rollers 43, the solvent removal control algorithms are simplified, the calculation time is shortened, and reduced load on the control system can be expected. On the other hand, it is difficult to respond to local excesses of solvent, and therefore, this composition is suitable for cases where high accuracy is not required in solvent removal.

Next, a mode is described with respect to FIGS. 13 to 17, in which portions having high treatment liquid and ink ejection volume (solvent volume) are extracted from the data, and blocks are established in accordance with the extracted portions. In FIGS. 13 to 17, items which are the same as or similar to those in FIG. 12 are denoted with the same reference numerals and description thereof is omitted here.

Figure 13:
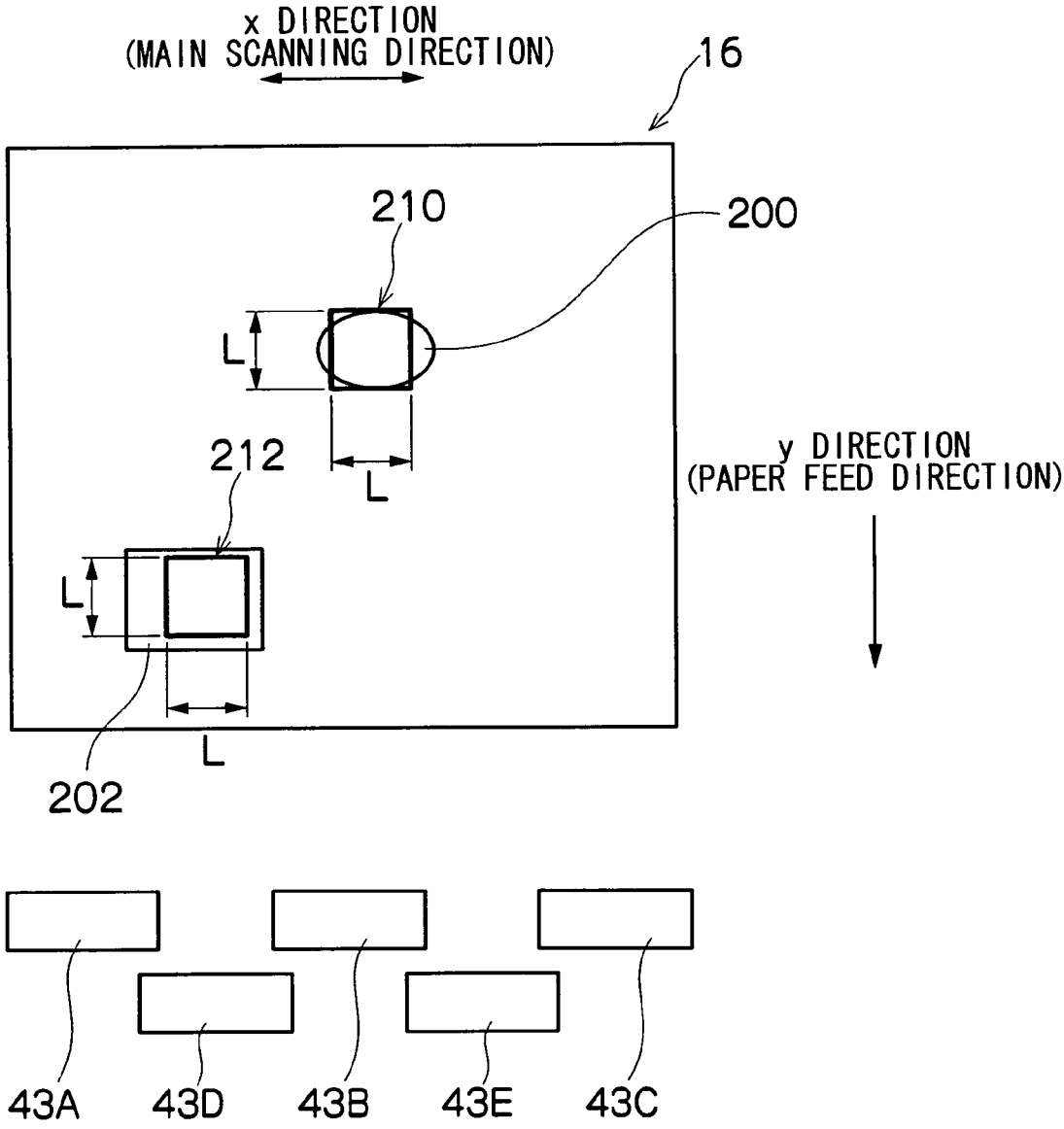
FIG. 13 is a diagram showing the specification of regions corresponding to the image contents.

As shown in FIG. 13, when the portions where the pictures 200 and 202 are to be formed on the recording paper 16 have been extracted, blocks 210 and 212 having a square shape with sides of a length L are extracted for the pictures 200 and 202. The length L of the sides of the blocks 210 and 212 is a length specified from the viewpoint of cockling, and if the value of L is changed in accordance with the type of recording paper 16, then highly accurate solvent removal can be achieved.

The ejection volume data is collected for each of the block 210 corresponding to the picture 200 and the block 212 corresponding to the picture 202. If the ejection volume data is greater than the previously specified threshold value in the block 210, then the solvent removal flag is raised for the block 210. If the ejection volume data is greater than the previously specified threshold value in the block 212, then the solvent removal flag is raised for the block 212.

Figure 14:
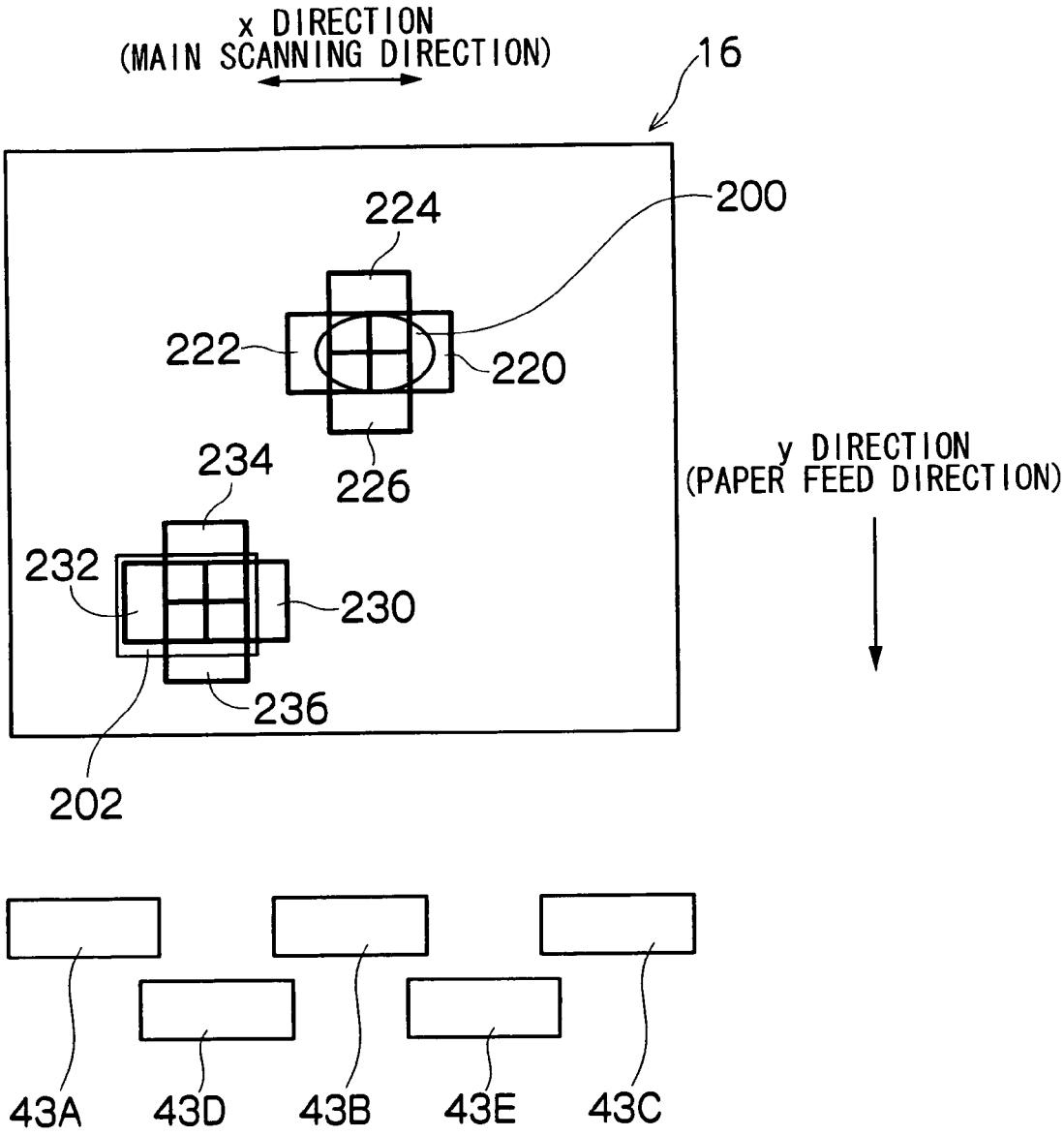
FIG. 14 is a diagram showing the calculation of ejection volume data.

Next, as shown in FIG. 14, the ejection volume data is gathered for blocks 220 and 222 which are shifted by L/2 in the x direction (main scanning direction) from the block 210, and for blocks 224 and 226 which are shifted by L/2 in the y direction (paper feed direction, and sub-scanning direction) from the block 210. Similarly, the ejection volume data is gathered for blocks 230 and 232 which are shifted by L/2 in the x direction from the block 202, and for blocks 234 and 236 which are shifted by L/2 in the y direction from the block 212.

The ejection volume data collected for each block in this way is compared with the threshold value, and the solvent removal flag is raised for any block in which the ejection volume data is greater than the threshold value. In FIG. 14, solvent removal flags are raised for the blocks 220, 222, 230, 232, 234 and 236.

Figure 15:
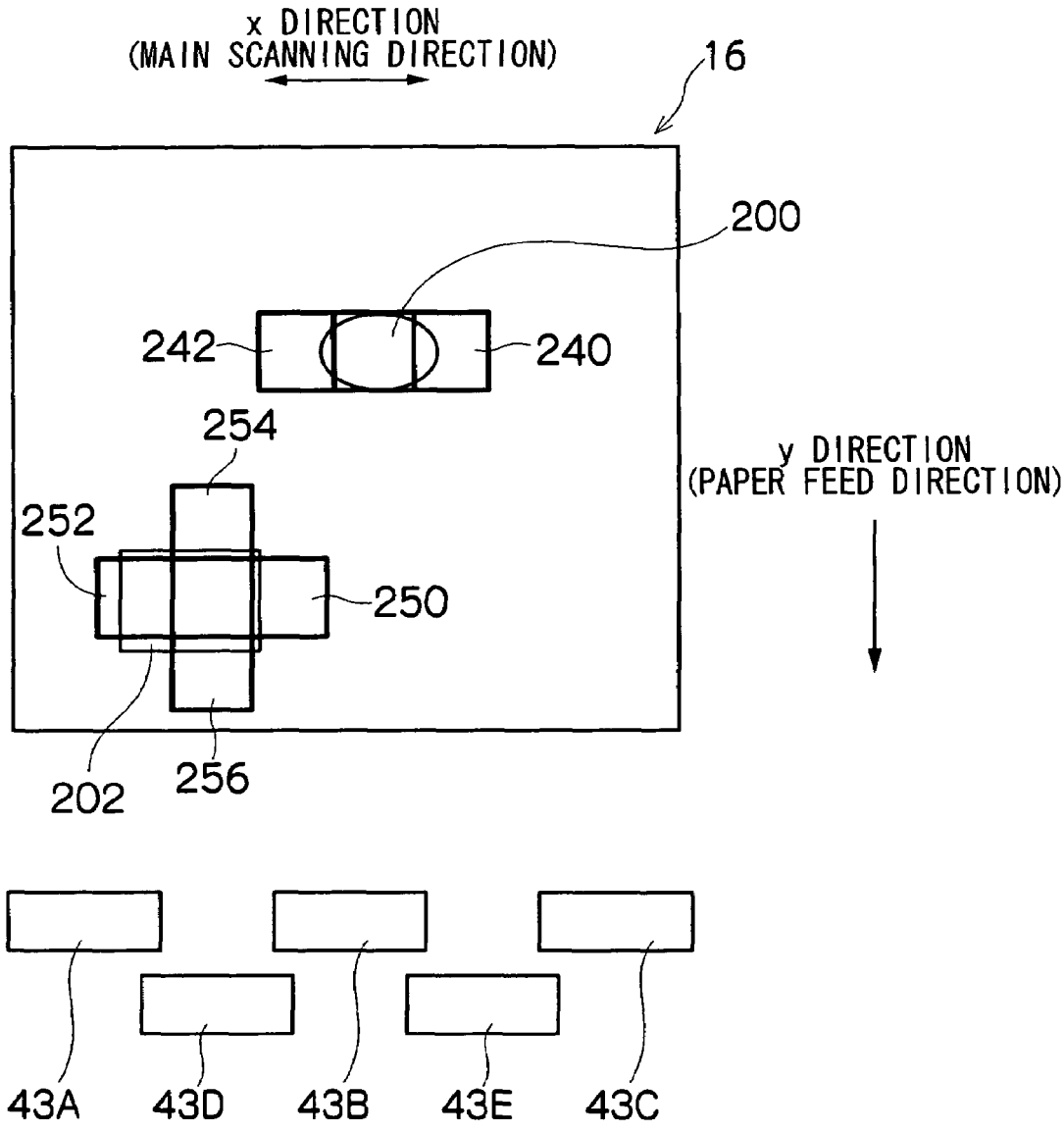
FIG. 15 is a diagram showing the specification of regions for calculating ejection volume data.

Moreover, as shown in FIG. 15, ejection volume data is also collected for each of blocks 240 and 242 shifted by L/2 in the x direction from the blocks 220 and 222 for which the solvent removal flag has been raised in FIG. 14, and for each of blocks 250, 252, 254 and 256 shifted by L/2 in the x direction and y direction from the blocks 230, 232, 234 and 236 for which the solvent removal flag has been raised in FIG. 14. The solvent removal flag is not raised for the blocks 224 and 226, and therefore, the collection of ejection volume data is terminated in the y direction of the picture 200, the collected ejection volume data is compared with the aforementioned threshold value, and it is judged whether or not solvent removal is to be carried out for each of the respective regions.

The blocks 240 and 242 in FIG. 15 have ejection volume data which is lower than the threshold value, and therefore, the solvent removal flag is not raised for these blocks 240 and 242. When the picture 200 has been covered with the blocks for which the solvent removal flag is not raised in this way, then the judgment procedure for whether or not to carry out solvent removal in the picture 200 terminates.

On the other hand, in the case of the blocks 250 to 256 corresponding to the picture 202, the ejection volume data is collected for each block, the collected ejection volume data is compared with the threshold value, and a judgment on whether or not to carry out solvent removal is made for each block. When the picture 202 has been covered with the blocks for which the solvent removal flag is not raised in this way, then the judgment procedure for whether or not to carry out solvent removal in the picture 202 terminates.

In other words, blocks having a desired size are established for each picture (the picture is divided into blocks having a desired size), and if the picture is covered with the blocks for which the solvent removal flag is not raised, or if solvent removal judgment has been carried out for the whole area of the possible image formation region of the recording paper 16, then the judgment of whether or not to carry out solvent removal for each of the divided blocks of the recording paper 16 terminates.

Figure 16:
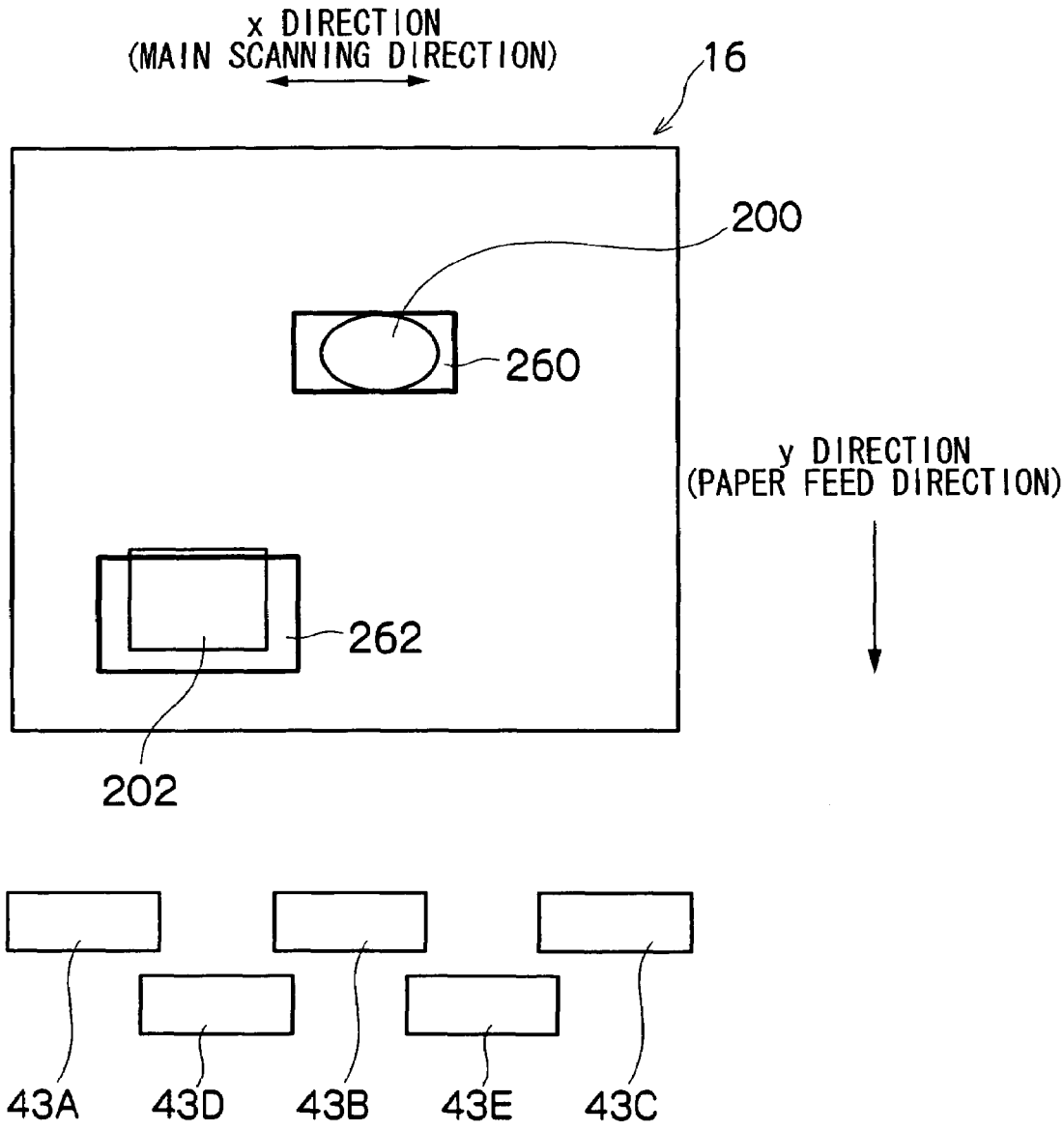
FIG. 16 is a diagram showing regions for which a solvent removal flag has been raised.
Figure 17:
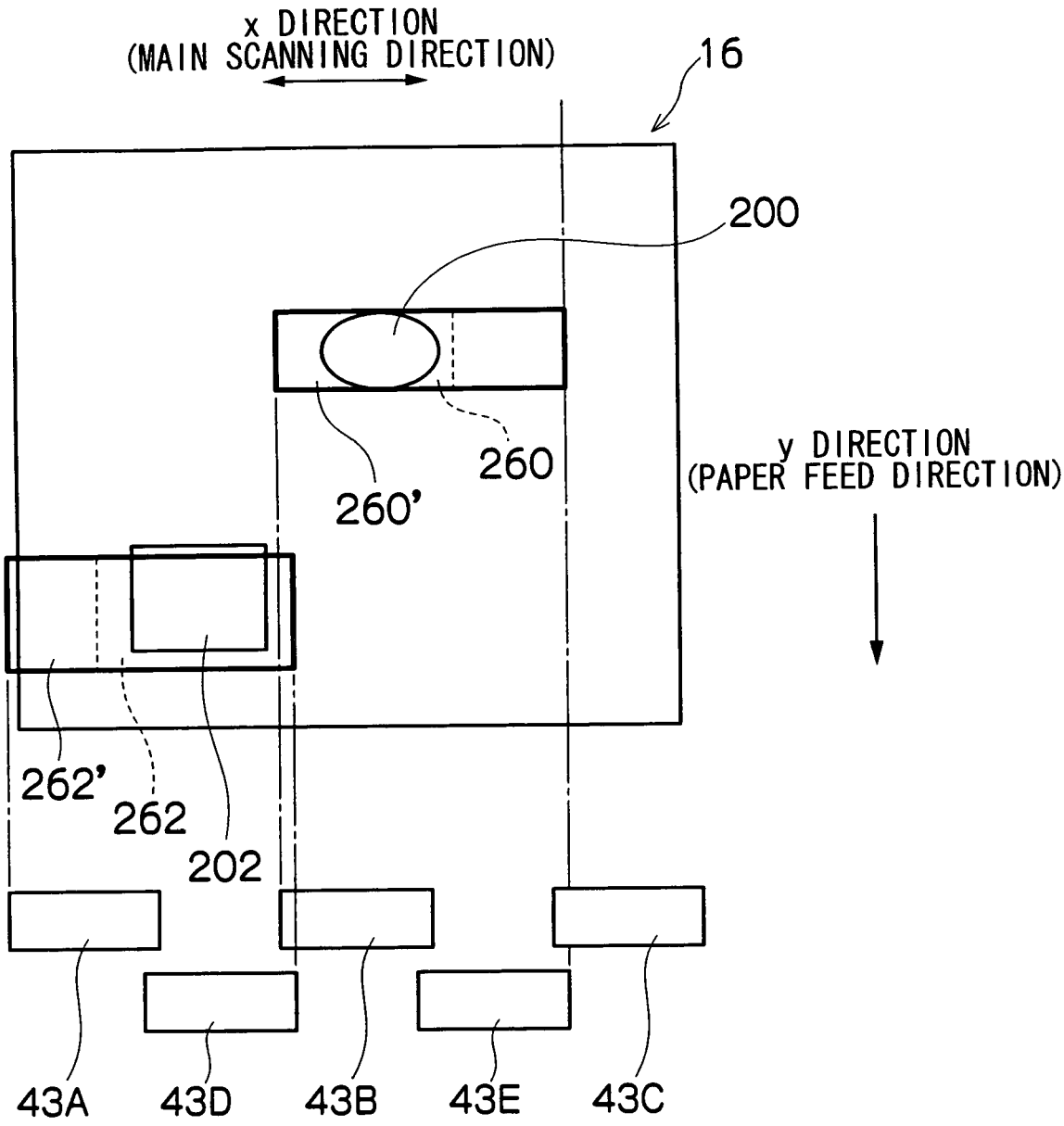
FIG. 17 is a diagram showing the relationship between regions where the solvent removal flag is raised and the absorbing rollers.

FIG. 16 shows a solvent removal region 260 for the picture 200 and a solvent removal region 262 for the picture 202. When the regions in which solvent removal is to be carried out have been determined in this way, the absorbing rollers 43 corresponding to the solvent removal regions 260 and 262 (indicated partially by the broken lines in FIG. 17) are selected as shown in FIG. 17, and solvent removal is carried out using the selected absorbing rollers 43.

In the solvent removal for the picture 200, the absorbing rollers 43B and 43E are selected, and solvent removal is carried out in the region 260' indicated by the solid lines. Furthermore, in the solvent removal for the picture 202, the absorbing rollers 43A and 43D are selected, and solvent removal is carried out in the region 262' indicated by the solid lines. In other words, in a region extending over a plurality of absorbing rollers 43, solvent removal is carried out by using the plurality of absorbing rollers 43.

By carrying out solvent removal by extracting regions having high treatment liquid and ink ejection volumes from the image data (ejection data) in this way, it becomes possible to achieve highly accurate solvent removal. However, in cases where there are portions of high and low ejection volume data within a certain region, there is a concern that the ejection volume data is averaged for the whole of that region, and hence it is desirable to implement processing which collects ejection volume data by changing the size of the specified blocks, or the like.

Description of Maintenance of Solvent Removal Unit

Next, the maintenance of the solvent removal unit 42 shown in FIGS. 1 and 2 is described. Firstly, the maintenance station 300 is described.

Figure 18:
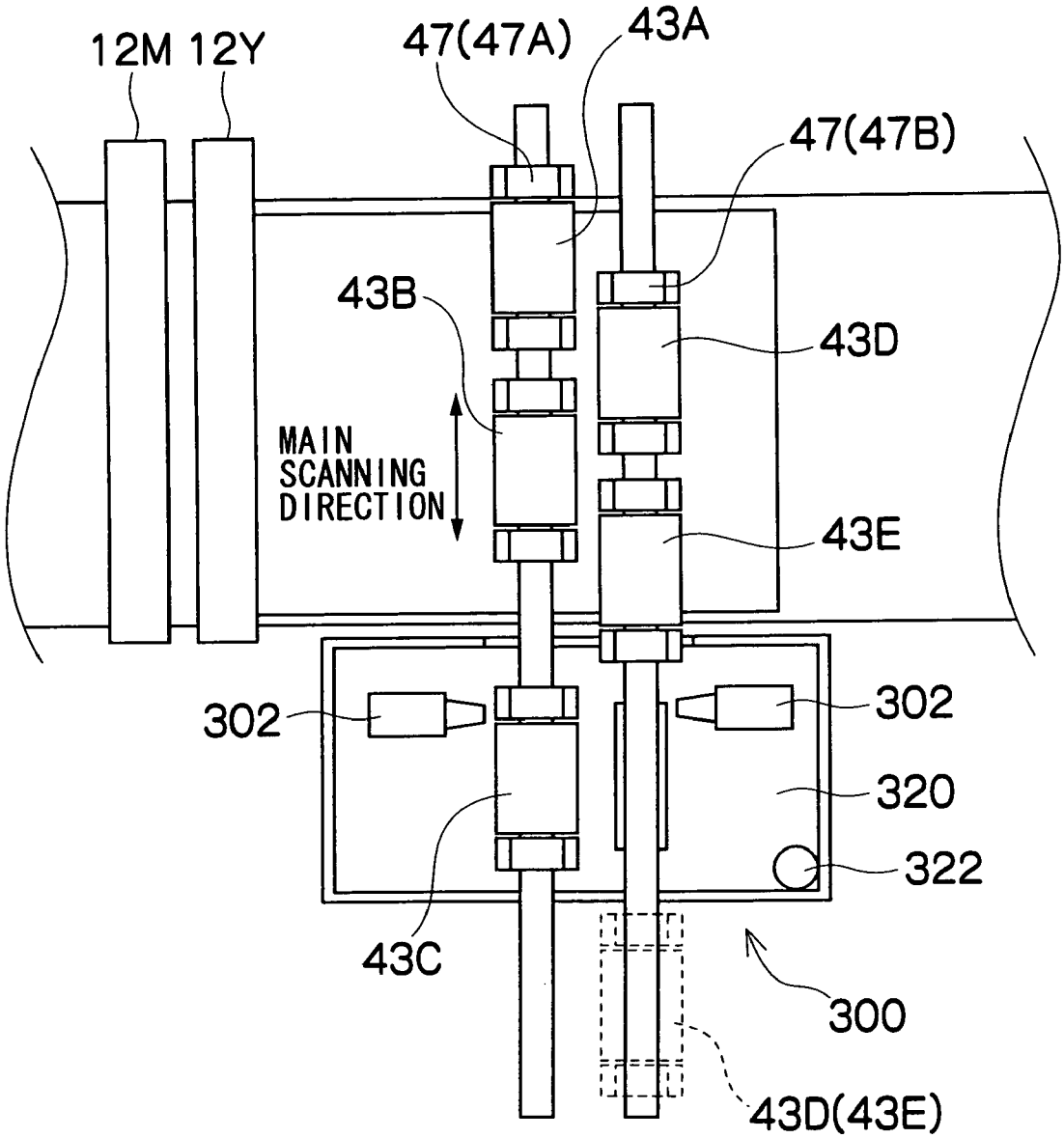
FIG. 18 is a principal plan diagram showing the composition of a maintenance station.
Figure 19:
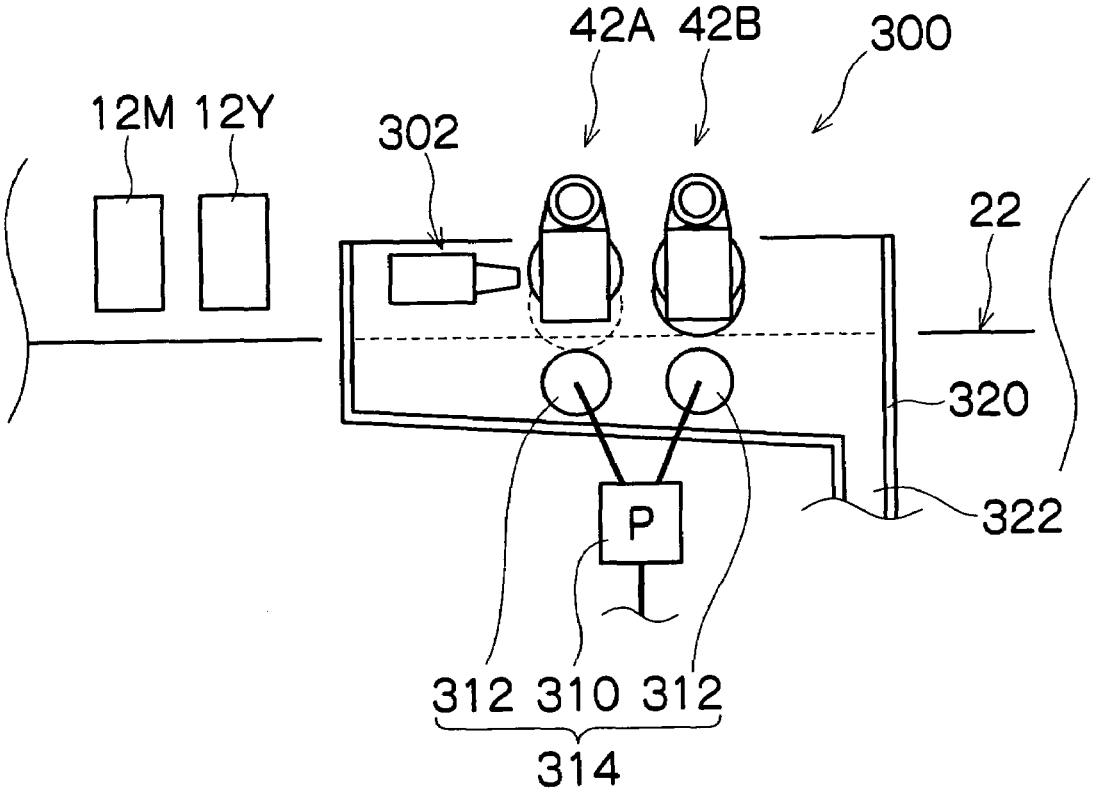
FIG. 19 is a diagram showing the composition of the maintenance station shown in FIG. 18.

FIG. 18 is a plan diagram showing the principal composition of the maintenance station 300 (corresponding to FIG. 2 which views the head 50 from the upper side), and FIG. 19 is a diagram of same viewed from the side (corresponding to FIG. 1).

As shown in FIGS. 18 and 19, the maintenance station 300 is constituted by a cleaning liquid ejection unit (cleaning unit) 302, provided to the side of the suction belt conveyance unit 22 (in a non-printing position), which cleans the absorbing rollers 43 by ejecting cleaning liquid onto the absorbing rollers 43 after removal of solvent, a solvent recovery unit 314, having recovery rollers 312 coupled to a suction pump 310, which recovers the solvent absorbed by the absorbing rollers 43, and a tray 320 which receives cleaning liquid, soiling, and the like, removed from the absorbing rollers 43. A tubing channel (drain) 322 is connected to a solvent disposal tank (for example, the collection tank 68 shown in FIG. 5), in which the liquid and soiling collected in the tray 320 is accumulated.

As shown in FIG. 18, the absorbing rollers 43 are composed so as to be independently movable in the main scanning direction (the direction of the arrow in the FIG. 18), and the absorbing rollers 43 are moved to a withdrawal position where the aforementioned maintenance station 300 is provided, after carrying out solvent removal from the recording paper 16.

In this embodiment, the mechanism which moves the absorbing rollers 43 independently in the sub-scanning direction are composed in such a manner that the absorbing rollers 43 and the elevator mechanisms 47 move integrally. The movement mechanism is composed by a carriage, which holds the absorbing rollers 43 and the elevator mechanism 47 integrally, a mechanism, such as a belt drive mechanism, or the like, for example, for moving the carriage, and a motor (actuator) or the like, which forms a drive source for this mechanism. The movement mechanism operates in accordance with a drive signal supplied by the control system shown in FIG. 6.

When the absorbing rollers 43 arrive at the withdrawal position, cleaning liquid, such as pure water, is applied to the absorbing rollers 43 from the cleaning liquid ejection unit, thereby removing soiling from the surface and interior of the absorbing rollers 43. FIG. 18 shows the state where the absorbing roller 43C is being cleaned in the withdrawal position.

Thereafter, the recovery rollers 312 abut against the absorbing rollers 43, and the surplus solvent absorbed by the absorbing rollers 43 is removed. The recovery rollers 312 are made of a material, such as a porous material or polymer having higher absorbability than the absorbing rollers 43.

The surplus solvent collected in the recovery rollers 312 is sent to the solvent disposal tank through the suction pump 310. It is also possible to generate a negative pressure by means of the pump 310, when recovering solvent from the absorbing rollers 43, in such a manner that the solvent is suctioned and removed from the absorbing rollers 43.

It is preferable that the absorbing rollers 43 are periodically subjected to the maintenance operation even when not performing solvent removal. Furthermore, a composition may be adopted in which the number of maintenance operations (maintenance duration) of the absorbing rollers 43 is stored in the memory 74, or the like, shown in FIG. 6, and if the number of maintenance operations (maintenance time duration) exceeds a prescribed value, then a report is issued indicating that replacement of the absorbing rollers 43 is due. The reporting device may issue a voice or warning sound, or it may display text-based information on a display device, such as a monitor. Furthermore, it may also issue a report based on a warning lamp, or the like.

Although omitted from the drawings, in order to prevent adherence of coloring material to the absorbing rollers 43, it is possible to provide a roller for the ink coloring material in the stage before the solvent removal unit 42 (on the upstream side thereof in terms of the paper feed direction), which is made of a different material to the absorbing rollers 43 and is designed with particular attention to fixing the ink coloring material.

Furthermore, it is also possible to provide a subsidiary solvent removal unit having an absorbing roller of lower absorption force than the absorbing rollers 43, or an absorbing roller having different pore size to the absorbing rollers 43, in a stage before the solvent removal unit 42, in such a manner that the absorption force can be adjusted. The absorption force may also be adjusted by altering the contact pressure between the absorbing rollers 43 and the recording paper 16.

In the inkjet recording apparatus 10 having the composition described above, it is judged whether or not to carry out solvent removal on the recording paper 16, and solvent removal is implemented on the basis of the result of this judgment. Therefore, since the absorbing rollers 43 only make contact with the recording paper 16 as and when necessary, it is possible to suppress deformation and wearing of the absorbing rollers 43, and thus to extend the lifespan of the absorbing rollers 43.

Furthermore, the absorbing rollers 43 have a divided structure in the main scanning direction, in such a manner that solvent removal can be performed independently by each of the divided absorbing rollers 43. Therefore, it is possible to control the absorbing rollers 43 in a detailed fashion in accordance with the distribution of solvent on the recording paper 16, and furthermore, improvements in the maintenance characteristics of the absorbing rollers 43 can be expected.

Since the printable region of the recording paper 16 is divided into a plurality of blocks and a judgment on whether or not to carry out solvent removal is made for each block, it is possible to judge whether or not to carry out solvent removal in accordance with the image that is formed on the recording paper 16. Moreover, since the control of solvent removal is performed (corrected) in accordance with the print conditions and environmental conditions, such as the type of recording paper 16 used, the temperature, the humidity, and the like, then it is possible to carry out desirable solvent removal in accordance with the aforementioned print conditions and environmental conditions.

The present embodiment is described with respect to the inkjet recording apparatus 10 for forming images on recording paper 16 by ejecting ink from nozzles provided in a print head, but the scope of application of the present invention is not limited to this, and it may also be applied broadly to image forming apparatuses which form images (three-dimensional shapes) by means of a liquid other than ink, such as resist, or to liquid ejection apparatuses, such as dispensers, which eject liquid chemicals, water, or the like, from nozzles (ejection holes).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a liquid ejection head which ejects liquid onto a liquid receiving medium;

a conveyance device which conveys the liquid receiving medium in a conveyance direction relatively to the liquid ejection head, by moving at least one of the liquid receiving medium and the liquid ejection head;

a liquid removal device which is arranged on a downstream side of the liquid ejection head in the conveyance direction and removes the liquid on the liquid receiving medium;

a movement device which varies a distance between the liquid removal device and the liquid receiving medium, by moving the liquid removal device;

an ejection volume determination device which determines a liquid ejection volume being a volume of the liquid ejected on the liquid receiving medium; and a liquid removal control device which determines whether or not to carry out liquid removal from the liquid receiving medium in accordance with the liquid ejection volume determined by the ejection volume determination device, and implements control for moving the liquid removal device in such a manner that the liquid removal device is placed in contact with the liquid on the liquid receiving medium if the liquid on the liquid receiving medium is to be removed, and the liquid removal device is not placed in contact with the liquid on the liquid receiving medium if the liquid on the liquid receiving medium is not to be removed.

2. The liquid ejection apparatus as defined in claim 1, further comprising:

a liquid receiving medium determination device which determines a type of the liquid receiving medium; and a threshold value specification device which specifies a threshold value corresponding to the liquid receiving medium, wherein the liquid removal control device compares the threshold value corresponding to the type of liquid receiving medium determined by the liquid receiving medium determination device with the liquid ejection volume determined by the ejection volume determination device, and implements control in such a manner that the liquid on the liquid receiving medium is removed in cases where the liquid ejection volume is greater than the threshold value.

3. The liquid ejection apparatus as defined in claim 2, further comprising:

a temperature information acquisition device which acquires ambient temperature information for the liquid receiving medium;

a humidity information acquisition device which acquires ambient humidity information for the liquid receiving medium; and a threshold value correction device which corrects the threshold value in accordance with at least one of the temperature information acquired by the temperature information acquisition device and the humidity information acquired by the humidity information acquisition device.

4. The liquid ejection apparatus as defined in claim 1, wherein the ejection volume determination device calculates the liquid ejection volume to be ejected onto the liquid receiving medium according to ejection data of the liquid ejected onto the liquid receiving medium.

5. The liquid ejection apparatus as defined in claim 4, further comprising:

an extraction device which extracts regions of high liquid ejection volume from a possible liquid ejection range on the liquid receiving medium, according to the liquid ejection volume calculated by the ejection volume determination device, wherein the liquid removal control device implements control in such a manner that liquid removal is performed in the regions extracted by the extraction device.

6. The liquid ejection apparatus as defined in claim 4, further comprising:

a dividing device which divides a possible liquid ejection range on the liquid receiving medium, into a plurality of blocks, wherein:

the ejection volume determination device determines the liquid ejection volume in each of the blocks of the liquid receiving medium divided by the dividing device; and the liquid removal control device implements control in such a manner that liquid removal is carried out in accordance with the liquid ejection volume determined for each block.

7. The liquid ejection apparatus as defined in claim 1, wherein:

the liquid removal device has a structure which is divided into a plurality of parts in a direction substantially perpendicular to the conveyance direction; and the liquid removal control device implements control in such a manner that liquid removal is performed by each of the divided parts of the liquid removal device.

8. The liquid ejection apparatus as defined in claim 1, further comprising a cleaning device which cleans the liquid removal device.

9. The liquid ejection apparatus as defined in claim 1, further comprising a recovery device which recovers the liquid received in the liquid removal device.

10. An inkjet recording apparatus, comprising the liquid ejection apparatus as defined in claim 1.

11. The inkjet recording apparatus as defined in claim 10, wherein the liquid ejection head comprises:

an ink ejection head which ejects ink which forms an image onto the liquid receiving medium; and a treatment liquid ejection head which ejects treatment liquid which causes the ink to fix on the liquid receiving medium by reacting with the ink.

12. A liquid removal method for a liquid ejection apparatus which ejects liquid onto a liquid receiving medium, the method comprising the steps of:

ejecting liquid onto a liquid receiving medium;

determining a volume of the liquid ejected on the liquid receiving medium;

removing the liquid on the liquid receiving medium by causing a liquid removal device to make contact with the liquid on the liquid receiving medium, in accordance with the volume of the liquid determined in the determining step; and after the removing step, moving the liquid removal device in a direction substantially perpendicular to a liquid receiving surface of the liquid receiving medium, in such a manner that the liquid removal device is not in contact with the liquid on the liquid receiving medium.

* * * * *